US007152032B2

(12) United States Patent
Suzuki et al.

(10) Patent No.: US 7,152,032 B2
(45) Date of Patent: Dec. 19, 2006

(54) VOICE ENHANCEMENT DEVICE BY SEPARATE VOCAL TRACT EMPHASIS AND SOURCE EMPHASIS

(75) Inventors: Masanao Suzuki, Kawasaki (JP); Masakiyo Tanaka, Kawasaki (JP); Yasuji Ota, Kawasaki (JP); Yoshiteru Tsuchinaga, Yokohama (JP)

(73) Assignee: Fujitsu Limited, Kawasaki (JP)

( * ) Notice: Subject to any disclaimer, the term of this patent is extended or adjusted under 35 U.S.C. 154(b) by 72 days.

(21) Appl. No.: 11/060,188

(22) Filed: Feb. 17, 2005

(65) Prior Publication Data

US 2005/0165608 A1 Jul. 28, 2005

Related U.S. Application Data

(63) Continuation of application No. PCT/JP2002/011332, filed on Oct. 31, 2002.

(51) Int. Cl.
*G10L 13/02* (2006.01)

(52) U.S. Cl. ..... 704/262; 704/219

(58) Field of Classification Search ..... None
See application file for complete search history.

(56) References Cited

U.S. PATENT DOCUMENTS

| | | | | |
|---|---|---|---|---|
| 5,233,660 | A * | 8/1993 | Chen | 704/208 |
| 5,295,224 | A * | 3/1994 | Makamura et al. | 704/223 |
| 5,327,521 | A * | 7/1994 | Savic et al. | 704/272 |
| 5,732,188 | A | 3/1998 | Moriya et al. | |
| 5,822,732 | A | 10/1998 | Tasaki | |
| 5,845,244 | A * | 12/1998 | Proust | 704/200.1 |
| 5,890,108 | A * | 3/1999 | Yeldener | 704/208 |
| 6,003,000 | A * | 12/1999 | Ozzimo et al. | 704/219 |
| 6,098,036 | A * | 8/2000 | Zinser et al. | 704/219 |
| 6,125,344 | A | 9/2000 | Kang et al. | |
| 6,240,384 | B1 * | 5/2001 | Kagoshima et al. | 704/220 |
| 6,950,799 | B1 * | 9/2005 | Bi et al. | 704/261 |

FOREIGN PATENT DOCUMENTS

| | | |
|---|---|---|
| EP | 0 742 548 | 8/2001 |
| JP | 2-082710 | 3/1990 |
| JP | 8-160992 | 6/1996 |
| JP | 8-248996 | 9/1996 |
| JP | 8-305397 | 11/1996 |
| JP | 9-160595 | 6/1997 |
| KR | 1999-0043060 | 6/1999 |

OTHER PUBLICATIONS

International Search Report dated Jan. 14, 2003.

* cited by examiner

*Primary Examiner*—Donald L. Storm
(74) *Attorney, Agent, or Firm*—Katten Muchin Rosenman LLP

(57) ABSTRACT

A voice intensifier capable of reducing abrupt changes in the amplification factor between frames and realizing excellent sound quality with less noise feeling by dividing input voices into the sound source characteristic and the vocal tract characteristic, so as to individually intensify the sound source characteristic and the vocal tract characteristic and then synthesize them before being output. The voice intensifier comprises a signal separation unit for separating the input sound signal into the sound source characteristic and the vocal tract characteristic, a characteristic extraction unit for extracting characteristic information from the vocal tract characteristic, a corrective vocal tract characteristic calculation unit for obtaining vocal tract characteristic correction information from the vocal tract characteristic and the characteristic information, a vocal tract characteristic correction unit for correcting the vocal tract characteristic by using the vocal tract characteristic correction information, and a signal synthesizing means for synthesizing the corrective vocal tract characteristic from the vocal tract characteristic correction unit and the sound source characteristic, so that the sound synthesized by the signal synthesizing means is output.

19 Claims, 22 Drawing Sheets

VOICE ENHANCEMENT DEVICE BY SEPARATE VOCAL TRACT EMPHASIS AND SOURCE EMPHASIS

CROSS-REFERENCE TO RELATED APPLICATION

This application is a continuation of International Application PCT/JP2002/011332 was filed on Oct. 31, 2002, the contents of which are herein wholly incorporated by reference.

BACKGROUND OF THE INVENTION

The present invention relates to a voice enhancement device which makes the received voice in a portable telephone or the like easier to hear in an environment in which there is ambient background noise.

In recent years, portable telephones have becomes popular, and such portable telephones are now used in various locations. Portable telephones are commonly used not only in quiet locations, but also in noisy environments with ambient noise such as airports and [train] station platforms. Accordingly, the problem of the received voice of portable telephones becoming difficult to hear as a result of ambient noise arises.

The simplest method of making the received voice easier to hear in a noisy environment is to increase the received sound volume in accordance with the noise level. However, if the received sound volume is increased to an excessive extent, there may be cases in which the input into the speaker of the portable telephone becomes excessive, so that sound quality conversely deteriorates. Furthermore, the following problem is also encountered: namely, if the received sound volume is increased, the burden on the auditory sense of the listener (user) is increased, which is undesirable from the standpoint of health.

Generally, when ambient noise is large, the clarity of voice is insufficient, so that the voice becomes difficult to hear. Accordingly, a method is conceivable in which the clarity is improved by amplifying the high-band components of the voice at a fixed rate. In the case of such a method, however, not only the high-band components, but also noise (transmission side noise) components contained in the received voice, are enhanced at the same time, so that the sound quality deteriorates.

Here, there are generally peaks in the voice frequency spectrum, and these peaks are called formants. An example of the voice frequency spectrum is shown in FIG. 1. FIG. 1 shows a case in which there are three peaks (formants) in the spectrum. In order from the low frequency side, these formants are called the first formant, second formant and third formant, and the peak frequencies fp(1), fp(2) and fp(3) of the respective formants are called the formant frequencies.

Generally, the voice spectrum has the property of showing a decrease in amplitude (power) as the frequency becomes higher. Furthermore, the voice clarity has a close relationship to the formants, and it is known that the voice clarity can be improved by enhancing the higher (second and third) formants.

An example of spectral enhancement is shown in FIG. 2. The solid line in FIG. 2 (*a*) and the dotted line in FIG. 2 (*b*) show the voice spectrum prior to enhancement. Furthermore, the solid line in FIG. 2 (*b*) shows the voice spectrum following enhancement. In FIG. 2 (*b*), the slope of the spectrum as a whole is flattened by increasing the amplitudes of the higher formants; as a result, the clarity of the voice as a whole can be improved.

A method using a band splitting filter (Japanese Patent Application Laid-Open No. 4-328798) is known as a method for improving clarity by enhancing such higher formants. In this method using a band filter, the voice is split into a plurality of frequency bands by part of this band splitting filter, and the respective frequency bands are separately amplified or attenuated. In this method, however, there is no guarantee that the voice formants will always fall within the split frequency bands; accordingly, there is a danger that components other than the formants will also be enhanced, so that the clarity conversely deteriorates.

Furthermore, a method in which protruding parts and indented parts of the voice spectrum are amplified or attenuated (Japanese Patent Application Laid-Open No. 2000-117573) is known as a method for solving the problems encountered in the abovementioned conventional method using a band filter. A block diagram of this conventional technique is shown in FIG. 3. In this method, the spectrum of the input voice is determined by a spectrum estimating part 100, protruding bands and indented bands are determined from the determined spectrum by a protruding band (peak)/indented band (valley) determining part 101, and the amplification factor (or attenuation factor) is determined for these protruding bands and indented bands.

Next, coefficients for realizing the abovementioned amplification factor (or attenuation factor) are given to a filter part 103 by a filter construction part 102, and enhancement of the spectrum is realized by inputting the input voice into the abovementioned filter part 103.

In other words, in conventional methods using a band filter, voice enhancement is realized by separately amplifying peaks and valleys of the voice spectrum.

In the abovementioned conventional technique, in the case of methods in which the sound quantity is increased, there are cases in which an increase in the sound quantity results in an excessive input into the speaker, so that the playback sound is distorted. Furthermore, if the received sound quantity is increased, the burden on the auditory sense of the listener (user) is increased, which is undesirable from a health standpoint.

Furthermore, in conventional methods using a high-band enhancement filter, if simple high-band enhancement is used, high bands of noise other than the voice are enhanced, so that the feeling of noise is increased, which does not always lead to an improvement in clarity.

Moreover, in conventional methods using a band splitting filter, there is no guarantee that the voice formants will always fall within the split frequency bands. Accordingly, there may be cases in which components other than the formants are enhanced, so that the clarity conversely deteriorates. Furthermore, since the input voice is amplified without separating the sound source characteristics and the vocal tract characteristics, the problem of severe distortion of the sound source characteristics arises.

FIG. 4 shows a voice production model. In the process of voice production, the sound source signal produced by the sound source (vocal chords) 110 is input into a sound adjustment system (vocal tract) 111, and vocal tract characteristics are added in this vocal tract 111. Subsequently, the voice is finally output as a voice waveform from the lips 112 (see "Onsei no Konoritsu Fugoka" ["High Efficiency Encoding of Voice"], pp. 69–71, by Toshio Nakada, Morikita Shuppan).

Here, the sound source characteristics and vocal tract characteristics are completely different characteristics; however, in the case of the abovementioned conventional technique using a band splitting filter, the voice is directly amplified without splitting the voice into sound source characteristics and vocal tract characteristics. Accordingly, the following problem arises: namely, the distortion of the sound source characteristics is great, so that the feeling of noise is increased, and the clarity deteriorates. An example is shown in FIGS. 5 and 6. FIG. 5 shows the input voice spectrum prior to enhancement processing. Furthermore, FIG. 6 shows the spectrum in a case where the input voice shown in FIG. 5 is enhanced by a method using a band splitting filter. In FIG. 6, the amplitude is amplified while maintaining the outline shape of the spectrum in the case of high band components of 2 kHz or greater. However, in the case of portions in the range of 500 Hz to 2 kHz (portions surrounded by circles in FIG. 6), it is seen that the spectrum differs greatly from the spectrum shown in FIG. 5 prior to enhancement, with a deterioration in the sound source characteristics.

Thus, in conventional methods using a band splitting filter, there is a danger that the distortion of the sound source characteristics will be great, so that the sound quality deteriorates.

Furthermore, in methods in which the abovementioned protruding portions or indented portions of the spectrum are amplified, the following problems exist.

First of all, as in the abovementioned conventional methods using a band splitting filter, the voice itself is directly enhanced without splitting the voice into sound source characteristics and vocal tract characteristics; accordingly, the distortion of the sound source characteristics is great, so that the feeling of noise is increased, thus causing a deterioration in clarity.

Secondly, direct formant enhancement is performed for the LPC (linear prediction coefficient) spectrum or FFT (frequency Fourier transform) spectrum determined from the voice signal (input signal). Consequently, in cases where the input voice is processed for each frame, the conditions of enhancement (amplification factor or attenuation factor) vary between frames. Accordingly, if the amplification factor or attenuation factor varies abruptly between frames, the feeling of noise is increased by the fluctuation of the spectrum.

Such a phenomenon is illustrated in a bird's eye view spectrum diagram. FIG. 7 shows the spectrum of the input voice (prior to enhancement). Furthermore, FIG. 8 shows the voice spectrum in a case where the spectrum is enhanced in frame units. In particular, FIGS. 7 and 8 show voice spectra in which frames that are continuous in time are lined up. It is seen from FIGS. 7 and 8 that the higher formants are enhanced. However, discontinuities are generated in the enhanced spectrum at around 0.95 seconds and around 1.03 seconds in FIG. 8. Specifically, in the spectrum prior to enhancement shown in FIG. 7, the formant frequencies vary smoothly, while in FIG. 8, the formant frequencies vary discontinuously. Such discontinuities in the formants are sensed as a feeling of noise when the processed voice is actually heard.

In FIG. 3, a method in which the frame length is increased is conceived as a method for solving the problem of discontinuity, which is the second of the abovementioned problems. If the frame length is lengthened, average spectral characteristics with little variation over time are obtained. However, when the frame length is lengthened, the problem of a large delay time arises. In communications applications such as portable telephones and the like, it is necessary to minimize the delay time. Accordingly, methods that increase the frame length are undesirable in communications applications.

DISCLOSURE OF THE INVENTION

The present invention was devised in light of the problems encountered in the prior art; it is an object of the present invention to provide a voice enhancement method which makes the voice clarity extremely easy to hear, and a voice enhancement device applying this method.

As a first aspect, the voice enhancement device that achieves the abovementioned object of the present invention is a voice enhancement device comprising a signal separating part which separates the input voice signal into sound source characteristics and vocal tract characteristics, a characteristic extraction part which extracts characteristic information from the abovementioned vocal tract characteristics, a vocal tract characteristic correction part which corrects the abovementioned vocal tract characteristics from the abovementioned vocal tract characteristics and the abovementioned characteristic information, and signal synthesizing part for synthesizing the abovementioned sound source characteristics and the abovementioned corrected vocal tract characteristics from the abovementioned vocal tract characteristic correction part, wherein a voice synthesized by the abovementioned signal synthesizing part is output.

As a second aspect, the voice enhancement device that achieves the abovementioned object of the present invention is a voice enhancement device comprising a self-correlation calculating part that determines the self-correlation function from the input voice of the current frame, a buffer part which stores the self-correlation of the abovementioned current frame, and which outputs the self-correlation function of a past frame, an average self-correlation calculating part which determines a weighted average of the self-correlation of the abovementioned current frame and the self-correlation function of the abovementioned past frame, a first filter coefficient calculating part which calculates inverse filter coefficients from the weighted average of the abovementioned self-correlation functions, an inverse filter which is constructed by the abovementioned inverse filter coefficients, a spectrum calculating part which calculates a frequency spectrum from the abovementioned inverse filter coefficients, a formant estimating part which estimates the formant frequency and formant amplitude from the abovementioned calculated frequency spectrum, an amplitude factor calculating part which determines the amplitude factor from the abovementioned calculated frequency spectrum, the abovementioned estimated formant frequency and the abovementioned estimated formant amplitude, a spectrum enhancement part which varies the abovementioned calculated frequency spectrum on the basis of the abovementioned amplitude factor, and determines the varied frequency spectrum, a second filter coefficient calculating part which calculates the synthesizing filter coefficients from the abovementioned varied frequency spectrum, and a synthesizing filter which is constructed from the abovementioned synthesizing filter coefficients, wherein a residual signal is determined by inputting the abovementioned input voice into the abovementioned inverse filter, and the output voice is determined by inputting the abovementioned residual signal into the abovementioned synthesizing filter.

As a third aspect, the voice enhancement device that achieves the abovementioned object of the present invention is a voice enhancement device comprising a linear prediction coefficient analysis part which determines a self-correlation function and linear prediction coefficients by subjecting the input voice signal of the current frame to a linear prediction coefficient analysis, an inverse filter that is constructed by the abovementioned coefficients, a first spectrum calculating part which determines the frequency spectrum from the abovementioned linear prediction coefficients, a buffer part which stores the self-correlation of the abovementioned current frame, and outputs the self-correlation function of a past frame, an average self-correlation calculating part which determines a weighted average of the self-correlation of the abovementioned current frame and the self-correlation function of the abovementioned past frame, a first filter coefficient calculating part which calculates average filter coefficients from the weighted average of the abovementioned self-correlation functions, a second spectrum calculating part which determines an average frequency spectrum from the abovementioned average filter coefficients, a formant estimating part which determines the formant frequency and formant amplitude from the abovementioned average spectrum, an amplitude factor calculating part which determines the amplitude factor from the abovementioned average spectrum, the abovementioned formant frequency and the abovementioned formant amplitude, a spectrum enhancement part which varies the frequency spectrum calculated by the abovementioned first spectrum calculating part on the basis of the abovementioned amplitude factor, and determines the varied frequency spectrum, a second filter coefficient calculating part which calculates the synthesizing filter coefficients from the abovementioned varied frequency spectrum, and a synthesizing filter which is constructed from the abovementioned synthesizing filter coefficients, wherein a residual signal is determined by inputting the abovementioned input signal into the abovementioned inverse filter, and the output voice is determined by inputting the abovementioned residual signal into the abovementioned synthesizing filter.

As a fourth aspect, the voice enhancement device that achieves the abovementioned object of the present invention is a voice enhancement device comprising a self-correlation calculating part which determines the self-correlation function from the input voice of the current frame, a buffer part which stores the self-correlation of the abovementioned current frame, and outputs the self-correlation function of a past frame, an average self-correlation calculating part which determines a weighted average of the self-correlation of the abovementioned current frame and the self-correlation function of the abovementioned past frame, a first filter coefficient calculating part which calculates inverse filter coefficients from the weighted average of the abovementioned self-correlation functions, an inverse filter which is constructed by the abovementioned inverse filter coefficients, a spectrum calculating part which calculates the frequency spectrum from the abovementioned inverse filter coefficients, a formant estimating part which estimates the formant frequency and formant amplitude from the abovementioned frequency spectrum, a tentative amplification factor calculating part which determines the tentative amplification factor of the current frame from the abovementioned frequency spectrum, the abovementioned formant frequency and the abovementioned formant amplitude, a difference calculating part which calculates the difference amplification factor from the abovementioned tentative amplification factor and the amplification factor of the preceding frame, and an amplification factor judgment part which takes the amplification factor determined from a predetermined threshold value and the amplification factor of the preceding frame as the amplification factor of the current frame in cases where the abovementioned difference is greater than this threshold value, and which takes the abovementioned tentative amplification factor as the amplification factor of the current frame in cases where the abovementioned difference is smaller than the abovementioned threshold value, this voice enhancement device further comprising, a spectrum enhancement part which varies the abovementioned frequency spectrum on the basis of the amplification factor of the abovementioned current frame, and which determines the varied frequency spectrum, a second filter coefficient calculating part which calculates synthesizing filter coefficients from the abovementioned varied frequency spectrum, a synthesizing filter which is constructed from the abovementioned synthesizing filter coefficients, a pitch enhancement coefficient calculating part which calculates pitch enhancement coefficients from the abovementioned residual signal, and a pitch enhancement filter which is constructed by the abovementioned pitch enhancement coefficients, wherein a residual signal is determined by inputting the abovementioned input voice into the abovementioned inverse filter, a residual signal whose pitch periodicity is enhanced is determined by inputting the abovementioned residual signal into the abovementioned pitch enhancement filter, and the output voice is determined by inputting the abovementioned residual signal whose pitch periodicity has been enhanced into the abovementioned synthesizing filter.

As a fifth aspect, the voice enhancement device that achieves the abovementioned object of the present invention is a voice enhancement device comprising an enhancement filter which enhances some of the frequency bands of the input voice signal, a signal separating part which separates the input voice signal that has been enhanced by the abovementioned enhancement filter into sound source characteristics and vocal tract characteristics, a characteristic extraction part which extracts characteristic information from the abovementioned vocal tract characteristics, a corrected vocal tract characteristic calculating part which determines vocal tract characteristic correction information from the abovementioned vocal tract characteristics and the abovementioned characteristic information, a vocal tract characteristic correction part which corrects the abovementioned vocal tract characteristics using the abovementioned vocal tract characteristic correction information, and signal synthesizing part for synthesizing the abovementioned sound source characteristics and the corrected vocal tract characteristics from the abovementioned vocal tract characteristic correction part, wherein a voice synthesized by the abovementioned signal synthesizing part is output.

As a sixth aspect, the voice enhancement device that achieves the abovementioned object of the present invention is a voice enhancement device comprising a signal separating part which separates the input voice signal into sound source characteristics and vocal tract characteristics, a characteristic extraction part which extracts characteristic information from the abovementioned vocal tract characteristics, a corrected vocal tract characteristic calculating part which determines vocal tract characteristic correction information from the abovementioned vocal tract characteristics and the abovementioned characteristic information, a vocal tract characteristic correction part which corrects the abovementioned vocal tract characteristics using the abovementioned vocal tract characteristic correction information, a signal synthesizing part which synthesizes the abovementioned sound source characteristics and the corrected vocal tract characteristics from the abovementioned vocal tract characteristic correction part, and a filter which enhances some of the frequency bands of the abovementioned signal synthesized by the abovementioned signal synthesizing part.

The further characteristics of the present invention will be clarified by the embodiments of the invention described below in accordance with the drawings.

BEST MODE FOR CARRYING OUT THE INVENTION

Embodiments of the present invention will be described below with reference to the attached figures.

Figure 9:
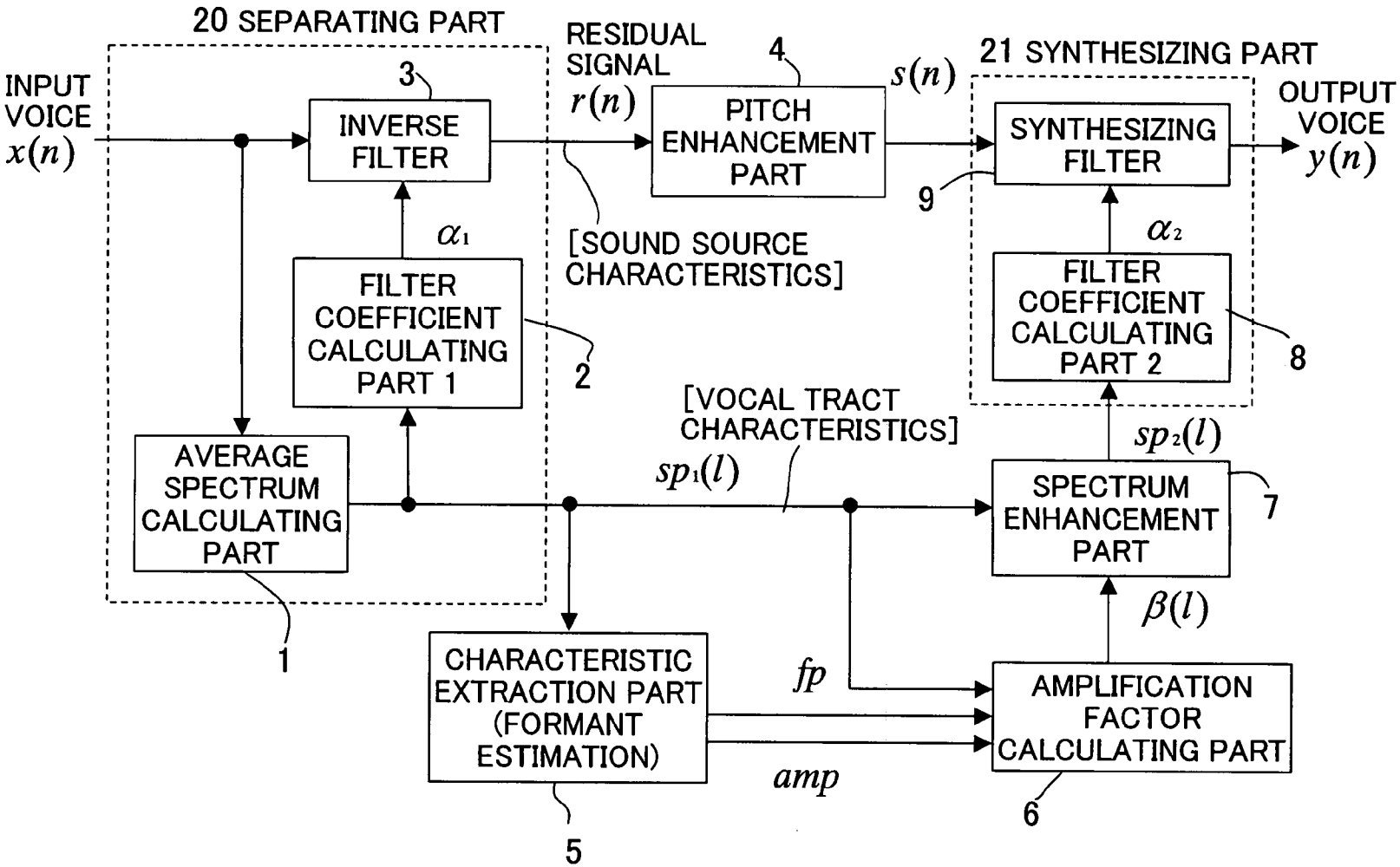
FIG. 9 is a diagram which shows the operating principle of the present invention.

FIG. 9 is a diagram which illustrates the principle of the present invention. The present invention is characterized by the fact that the input voice is separated into sound source characteristics and vocal tract characteristics by a separating part 20, the sound source characteristics and vocal tract characteristics are separately enhanced, and these characteristics are subsequently synthesized and output by a synthesizing part 21. The processing shown in FIG. 9 will be described below.

In the time axis region, the input voice signal x(n), $(0 \leqq n < N)$ (here, N is the frame length) which has an amplitude value that is sampled at a specified sampling frequency is obtained, and the average spectrum $sp_1(l)$, $(0 \leqq l < N_F)$ is calculated from this input voice signal x(n) by the average spectrum calculating part 1 of the separating part 20.

Accordingly, in the average spectrum calculating part 1, which is a linear prediction circuit, the self-correlation function of the current frame is first calculated. Next, the average self-correlation is determined by obtaining a weighted average of the self-correlation function of said current frame and the self-correlation function of a past frame. The average spectrum $sp_1(l)$, $(0 \leqq l < N_F)$ is determined from this average self-correlation. Furthermore, $N_F$ is the number of data points of the spectrum, and $N \leqq N_F$. Moreover, $sp_1(l)$ may also be calculated as the weighted average of the LPC spectrum or FFT spectrum calculated from the input voice of the current frame and the LPC spectrum or FFT spectrum calculated from the input voice of the past frame.

Next, the spectrum $sp_1(l)$ is input into the first filter coefficient calculating part 2 inside the separating part 20, and the inverse filter coefficients $\alpha_1(i)$, $(1 \leqq i \leqq p_1)$ Here, $p_1$ is the filter order number of the inverse filter 3.

The input voice x(n) is input into the inverse filter 3 inside the separating part 20 constructed by the abovementioned determined inverse filter coefficients $\alpha_1(i)$, so that a residual signal r(n), $(0 \leqq n < N)$. As a result, the input voice can be separated into the residual signal r(n) constituting sound source characteristics, and the spectrum $sp_1(l)$ constituting vocal tract characteristics.

The residual signal r(n) is input into a pitch enhancement part 4, and a residual signal s(n) in which the pitch periodicity is enhanced is determined.

Meanwhile, the spectrum $sp_1(l)$ constituting vocal tract characteristics is input into a formant estimating part 5 used as a characteristic extraction part, and the formant frequency fp(k), $(1 \leqq k \leqq k_{max})$ and formant amplitude amp(k), $(1 \leqq k \leqq k_{max})$ are estimated. Here, $k_{max}$ is the number of formants estimated. The value of $k_{max}$ is arbitrary; however, for a voice with a sampling frequency of 8 kHz, $k_{max}$ can be set at 4 or 5.

Then, the spectrum $sp_1(l)$, formant frequency fp(k) and formant amplitude amp(k) are input into the amplification factor calculating part 6, and the amplification factor $\beta(l)$ for the spectrum $sp_1(l)$ is calculated.

The spectrum $sp_1(l)$ and amplification factor $\beta(l)$ are input into the spectrum enhancement part 7, so that the enhanced spectrum $sp_2(l)$ is determined. This enhanced spectrum $sp_2(l)$ is input into a second filter coefficient calculating part 8 which determines the coefficients of the synthesizing filter 9 that constitutes the synthesizing part 21, so that synthesizing filter coefficients $\alpha_2(i)$, $(1 \leqq i \leqq p_2)$. Here, $p_2$ is the filter order number of the synthesizing filter 9.

The residual signal s(n) following pitch enhancement by the abovementioned pitch enhancement part 4 is input into the synthesizing filter 9 constructed by the synthesizing filter coefficients $\alpha_2(i)$, so that the output voice y(n), $(0 \leqq n < N)$ is determined. As a result, the sound source characteristics and vocal tract characteristics that have been subjected to enhancement processing are synthesized.

In the present invention, since the input voice is separated into sound source characteristics (residual signal) and vocal tract characteristics (spectrum envelope) as described above, enhancement processing suited to the respective characteristics can be performed. Specifically, the voice clarity can be improved by enhancing the pitch periodicity in the case of the sound source characteristics, and enhancing the formants in the case of the vocal tract characteristics.

Furthermore, since long-term voice characteristics are used as the vocal tract characteristics, abrupt variations in the amplification factor between frames are reduced; accordingly, a good voice quality with little feeling of noise can be realized. In particular, average spectral characteristics with little fluctuation over time can be obtained without increasing the delay time by using a weighted average of the self-correlation calculated from the input signal of the current frame and the self-correlation calculated from the input signal of a past frame. Accordingly, abrupt variations in the amplification factor used for spectrum enhancement can be suppressed, so that the feeling of noise caused by voice enhancement can be suppressed.

Next, an embodiment applying the principle of the present invention shown in FIG. 9 will be described below.

Figure 10:
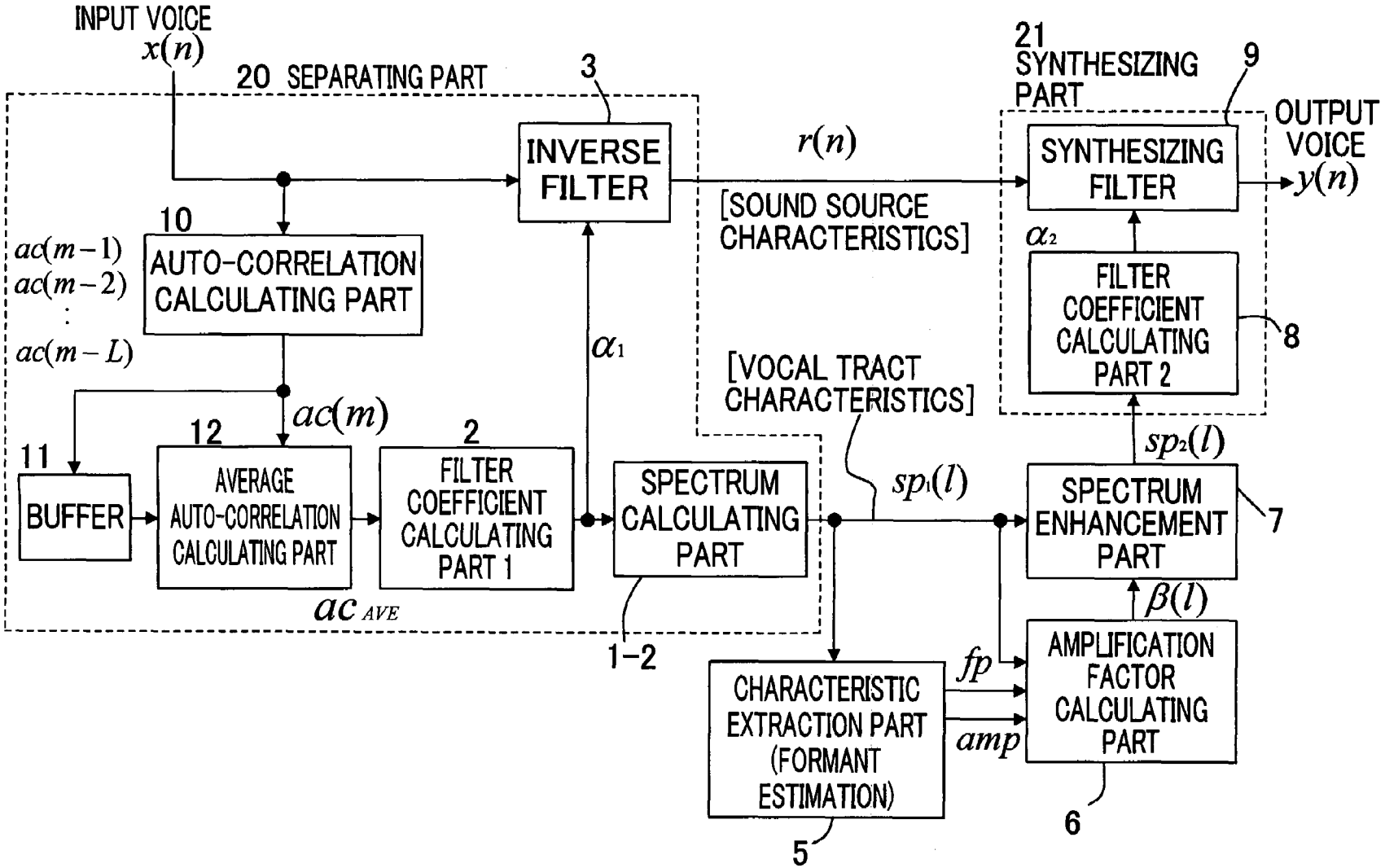
FIG. 10 is a diagram which shows constituent blocks of a first embodiment of the present invention.

FIG. 10 is a block diagram of the construction of a first embodiment according to the present invention.

In this figure, the pitch enhancement part 4 is omitted (compared to the principle diagram shown in FIG. 9).

Furthermore, in regard to the embodied construction of the separating part 20, the average spectrum calculating part 1 inside the separating part 29 is split between the front and back of the filter coefficient calculating part 2; in the pre-stage of the filter coefficient calculating part 2, the input voice signal x(n), (0≦n<N) of the current frame is inoput into the self-correlation calculating part 10; here, the self-correlation function ac (m) (i), (0≦i≦$p_1$) of the current frame is determined by part of Equation (1). Here, N is the frame length. Furthermore, m is the frame number of the current frame, and $p_1$ is the order number of the inverse filter described later.

$$ac(m)(i) = \sum_{n=i}^{N-1} x(n) \cdot x(n-i),\ (0 \le i \le p_1) \tag{1}$$

Furthermore, in the separating part 20, the self-correlation function ac(m−j) (i), (1≦j≦L, 0≦i≦$p_1$) in the immediately preceding L frame is output from the buffer part 11. Next, the average self-correlation $ac_{AVE}(i)$ is determined by the average self-correlation calculating part 12 from the self-correlation function ac (m) (i) of the current frame determined by the self-correlation calculating part 10 and the past self-correlation from the abovementioned buffer part 11.

Here, the method used to determine the average self-correlation $ac_{AVE}(i)$ is arbitrary; however, for example, the weighted average of Equation (2) can be used. Here, $w_j$ is a weighting coefficient.

$$ac_{AVE}(i) = \frac{1}{L+1}\sum_{j=0}^{L} w_j \cdot ac(m-j)(i),\ (0 \le i \le p_1) \tag{2}$$

Here, updating of the state of the buffer part 11 is performed as follows. First, the oldest ac(m−L)(i) (in terms of time) among the past self-correlation functions stored in the buffer part 11 is discarded. Next, the ac(m) (i) calculated in the current frame is stored in the buffer part 11.

Furthermore, in the separating part 20, the inverse filter coefficients $\alpha_1(i)$, (1≦i≦$p_1$) are determined in the first filter coefficient calculating part 2 by a universally known method such as a Levinson algorithm or the like from the average self-correlation $ac_{AVE}(i)$ determined by the average self-correlation calculating part 12.

The input voice x(n) is input into the inverse filter 3 constructed by the filter coefficients $\alpha_1(i)$, and a residual signal r(n), (0≦n<N) is determined as sound source characteristics by Equation (3).

$$r(n) = x(n) + \sum_{i=1}^{p_1} \alpha_1(i)x(n-i),\ (0 \le n < N) \tag{3}$$

Meanwhile, in the separating part 20, the coefficients $\alpha_1(i)$ determined by the filter coefficient calculating part 2 are subjected to a Fourier transform by part of the following Equation (4) in a spectrum calculating part 1-2 disposed in the after-stage of the filter coefficient calculating part 2, so that the LPC spectrum $sp_1(l)$ is determined as vocal tract characteristics.

$$sp_1(l) = \left| \frac{1}{1 + \sum_{i=1}^{p_1} \alpha_1(i) \cdot \exp(-j2\pi il/N_F)} \right|^2,\ (0 \le l < N_F) \tag{4}$$

Here, $N_F$ is the number of data points of the spectrum. If the sampling frequency is $F_s$, then the frequency resolution of the LPC spectrum $sp_1(l)$ is $F_s/N_F$. The variable l is a spectrum index, and indicates the discrete frequency. If l is converted into a frequency [Hz], then int[$l \times F_s/N_F$] [Hz] is obtained. Furthermore, int[x] indicates the conversion of the variable x into an integer (the same is true in the description that follows).

As was described above, the input voice can be separated into a sound source signal (residual signal r(n), (0≦n<N) and vocal tract characteristics (LPC spectrum $sp_1(l)$) by the separating part 20.

Next, as was described in FIG. 9, the spectrum $sp_1(l)$ is input into the formant estimating part 5 as one example of the characteristic extraction part, and the formant frequency fp(k), (1≦k≦$k_{max}$) and formant amplitude amp(k), (1≦k≦$k_{max}$) are estimated. Here, $k_{max}$ is the number of formants estimated. The value of $k_{max}$ is arbitrary; however, in the case of a voice with a sampling frequency of 8 kHz, $k_{max}$ can be set at 4 or 5.

A universally known method such as a method in which the formants are determined from the roots of higher order equations using the inverse filter coefficients $\alpha_1(i)$ are used as coefficients, or a peak picking method in which the formants are estimated from the peaks of the frequency spectrum, can be used as the formant estimating method. The formant frequencies are designated (in order from the lowest frequency) as fp(1), fp(2), K, fp($k_{max}$). Furthermore, a threshold value may be set for the formant band width, and the system may be devised so that only frequencies with a band width equal to or less than this threshold value are taken as formant frequencies.

Furthermore, in the formant estimating part 5, the formant frequencies fp(k) are converted into discrete forman frequencies fpl(k)=int[fp(k)×$N_F/F_s$]. Furthermore, the spectrum $sp_1$(fpl(k)) is taken as the formant amplitude amp(k).

Such a spectrum $sp_1$(l), discrete formant frequencies fp(k) and formant amplitudes amp(k) are input into the amplification factor calculating part 6, and the amplification factor β(l) for the spectrum $sp_1$(l) is calculated.

Figure 11:
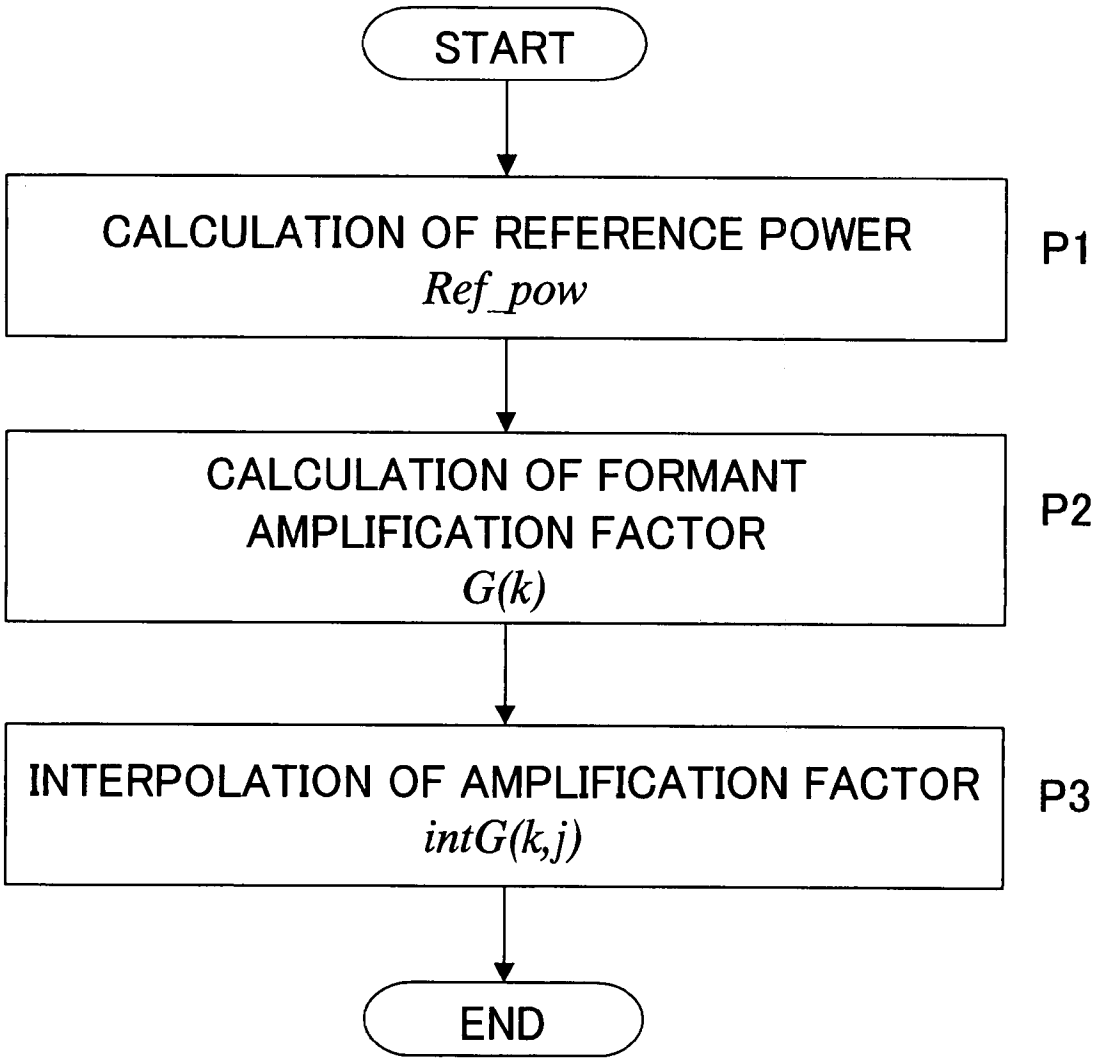
FIG. 11 is a flow chart which shows the processing of the amplification factor calculating part 6 in the embodiment shown in FIG. 10.

In regard to the processing of the amplification factor calculating part 6, as is shown in the processing flow of FIG. 11, processing is performed in the order of calculation of the reference power (processing step P1), calculation of the formant amplification factor (processing step P2), and interpolation of the amplification factor (processing step P3). Below, the respective processing steps will be described in order.

Processing step P1: The reference power Pow_ref is calculated from the spectrum $sp_1$(l). The calculation method is arbitrary; however, for example, the average power for all frequency bands or the average power for lower frequencies can be used as the reference power. In cases where the average power for all frequency bands is used as the reference power, Pow_ref is expressed by the following Equation (5).

$$\text{Pow_ref} = \frac{1}{N_F}\sum_{l=0}^{N_F-1} sp_1(l) \tag{5}$$

Processing step P2: The amplification factor G(k) that is used to match the amplitude of the formants F(k) to the reference power Pow_ref is determined by the following Equation (6).

$$G(k)=\text{Pow_ref}/\text{amp}(k)\ (0\leqq n<N_F) \tag{6}$$

Figure 12:
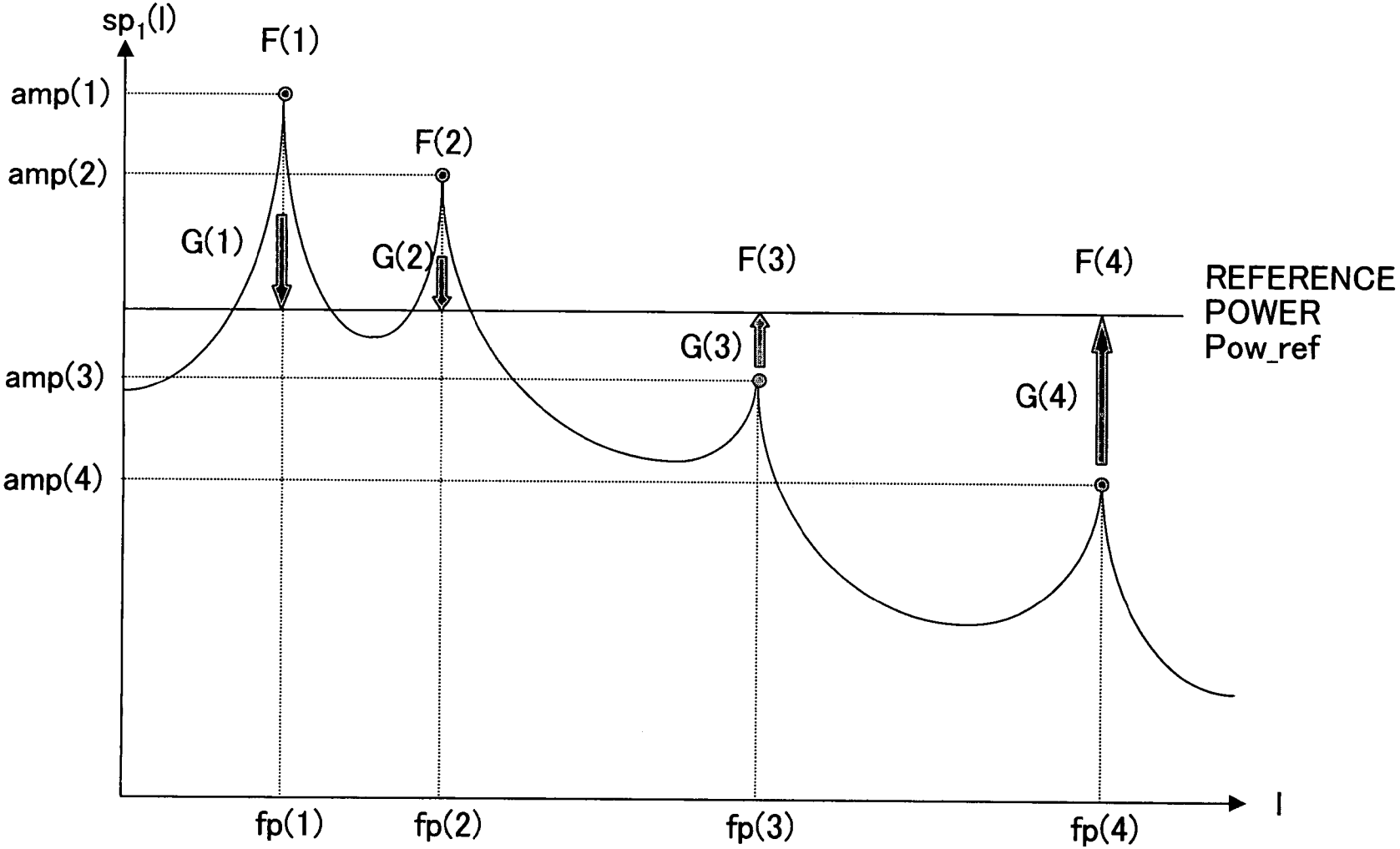
FIG. 12 is a diagram which shows the conditions in a case where the amplitude of the formants F(k) in the embodiment shown in FIG. 10 is adjusted in accordance with the reference power Pow_ref.
Figure 13:
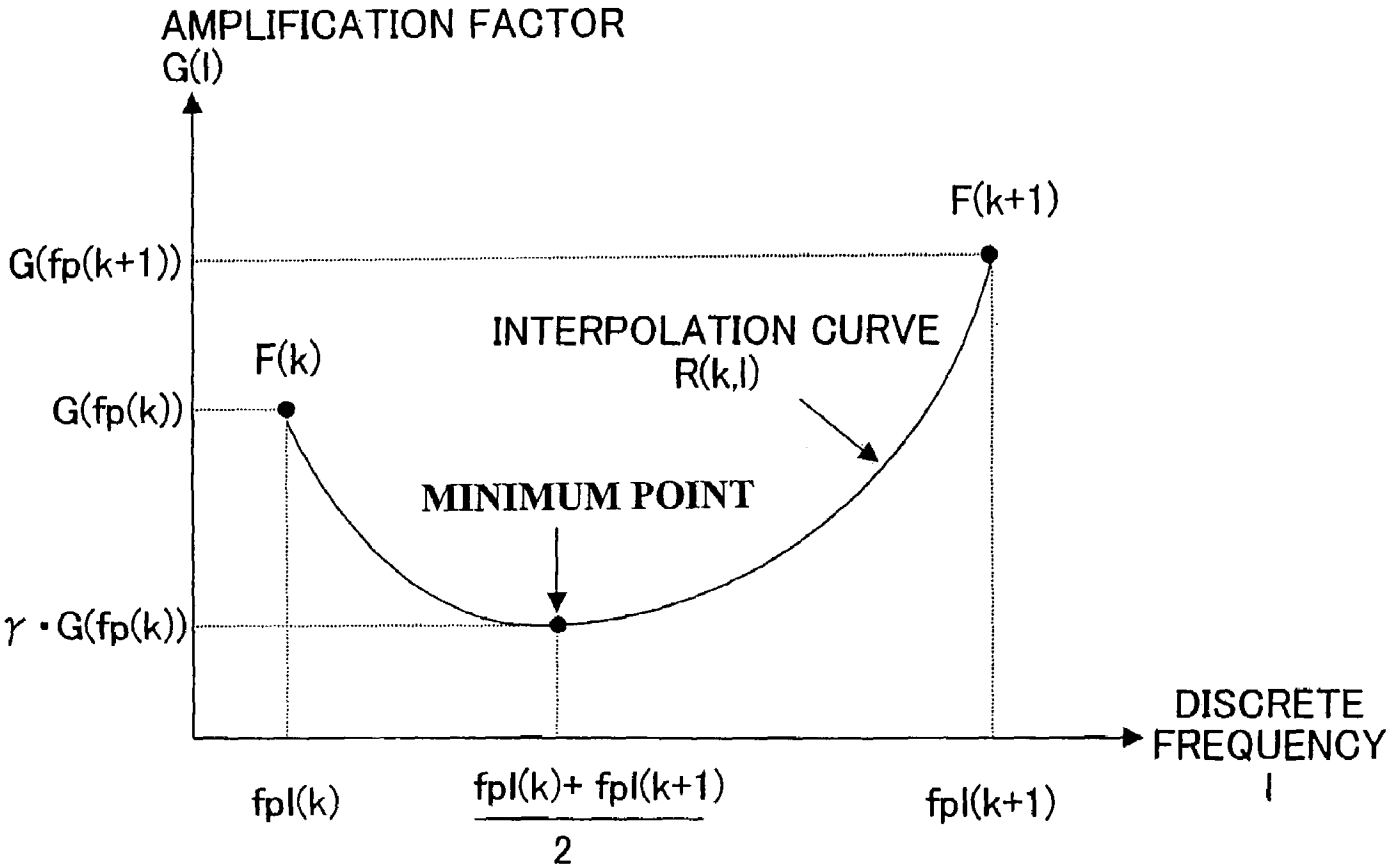
FIG. 13 PRIOR ART
FIG. 13 is a diagram which illustrates the determination of the amplification factor $\beta(l)$ at frequencies between formants by part of an interpolation curve R(k,l)

FIG. 12 shows how the amplitude of the formants F(k) is matched to the reference power Pow_ref. Furthermore, in FIG. 12, the amplification factor β(l) at frequencies between formants is determined using the interpolation curve R(k, l). The shape of the interpolation curve R(k, l) is arbitrary; for example, however, a first-order function or second-order function can be used. FIG. 13 shows an example of a case in which a second-order curve is used as the interpolation curve R(k, l). The interpolation curve R(k, l) is defined as shown in Equation (7). Here, a, b and c are parameters that determine the shape of the interpolation curve.

$$R(k,l)=\alpha\cdot l^2+b\cdot l+c \tag{7}$$

As is shown in FIG. 13, minimum points of the amplification factor are set between adjacent formants F(k) and F(k+1) inn such an interpolation curve. Here, the method used to set the minimum points is arbitrary; however, for example, the frequency (fpl(k)+fpl(k+1))/2 can be set as a minimum point, and the amplification factor in this case is set as γ×G(k). Here, γ is a constant, and 0<γ<1.

Assuming that the interpolation curve R(k, l) passes through the formants F(k) and F(k+1) and minimum points, then the following Equations (8), (9) and (10) hold true.

$$G(k) = a\cdot fpl(k)^2 + b\cdot fpl(k) + c \tag{8}$$

$$G(k+1) = a\cdot fpl(k+1)^2 + b\cdot fpl(k+1) + c \tag{9}$$

$$\gamma\cdot G(k) = a\cdot\left(\frac{fpl(k)+fpl(k+1)}{2}\right)^2 + b\cdot\left(\frac{fpl(k)+fpl(k+1)}{2}\right) + c \tag{10}$$

If Equations (8), (9) and (10) are solved as simultaneous equations, the parameters a, b and c are determined, and the interpolation curve R(k, l) is determined. Then, the amplification factor β(l) for the spectrum between F(k) and F(k+1) is determined on the basis of the interpolation curve R(k, l).

Furthermore, the determination of the interpolation curve R(k, l) between the abovementioned adjacent formants and the processing that determines the amplification factor β(l) for the spectrum between adjacent formants are performed for all of the formants.

Moreover, in FIG. 12, the amplification factor G(1) for the first formant is used for frequencies lower than the first formant F(1). Furthermore, the amplification factor $G(k_{max})$ for the highest formant is used for frequencies higher than the highest formant. The above may be summarized as shown in Equation (11).

$$\beta(l) = \begin{cases} G(1), & (l < fpl(1)) \\ R(k, l). & (fpl(1) \le l \le fpl(k_{\max})) \\ G(k_{\max}), & (fpl(k_{\max}) < l) \end{cases} \tag{11}$$

Returning to FIG. 10, the spectrum $sp_1$(l) and the amplification factor β(l) are input into the spectrum enhancement part 7, and the enhanced spectrum $sp_2$(l) is determined using Equation (12).

$$sp_2(l)=\beta(l)\cdot sp_1(l),\ (0\leqq l<N_F) \tag{12}$$

Next, the enhanced spectrum $sp_2$(l) is input into the second filter coefficient calculating part 8. In the second filter coefficient calculating part 8, the self-correlation function $ac_2$(i) is determined from the inverse Fourier transform of the enhanced spectrum $sp_2$(l), and the synthesizing filter coefficients $\alpha_2$(i), ($1\leqq i\leqq p_2$) are determined from $ac_2$(i) by a universally known method such as a Levinson algorithm or the like. Here, $p_2$ is the synthesizing filter order number.

Furthermore, the residual signal r(n) which is the output of the inverse filter 3 is input into the synthesizing filter 9 constructed by the coefficients $a_2$(i), and the output voice y(n), (0≦n<N) is determined as shown in Equation (13).

$$y(n) = r(n) - \sum_{i=1}^{p_2}\alpha_2(i)y(n-i),\ (0 \le n < N) \tag{13}$$

In the embodiment shown in FIG. 10, as was described above, the input voice can be separated into sound source characteristics and vocal tract characteristics, and the system can be devised so that only the vocal tract characteristics are enhanced. As a result, the spectrum distortion occurring in cases where the vocal tract characteristics and sound source characteristics are simultaneously enhanced, which is a problem in conventional techniques, can be suppressed, and the clarity can be improved. Furthermore, in the embodiment shown in FIG. 10, the pitch enhancement part 4 is omitted; however, in accordance with the principle diagram shown in FIG. 9, it would also be possible to install a pitch enhancement part 4 on the output side of the inverse filter 3, and to perform pitch enhancement processing on the residual signal r(n).

Furthermore, in the present embodiment, the amplification factor for the spectrum $sp_1$(l) is determined in units of 1 spectrum point number; however, it would also be possible to split the spectrum into a plurality of frequency bands, and to establish a separate amplification factor for each band.

Figure 14:
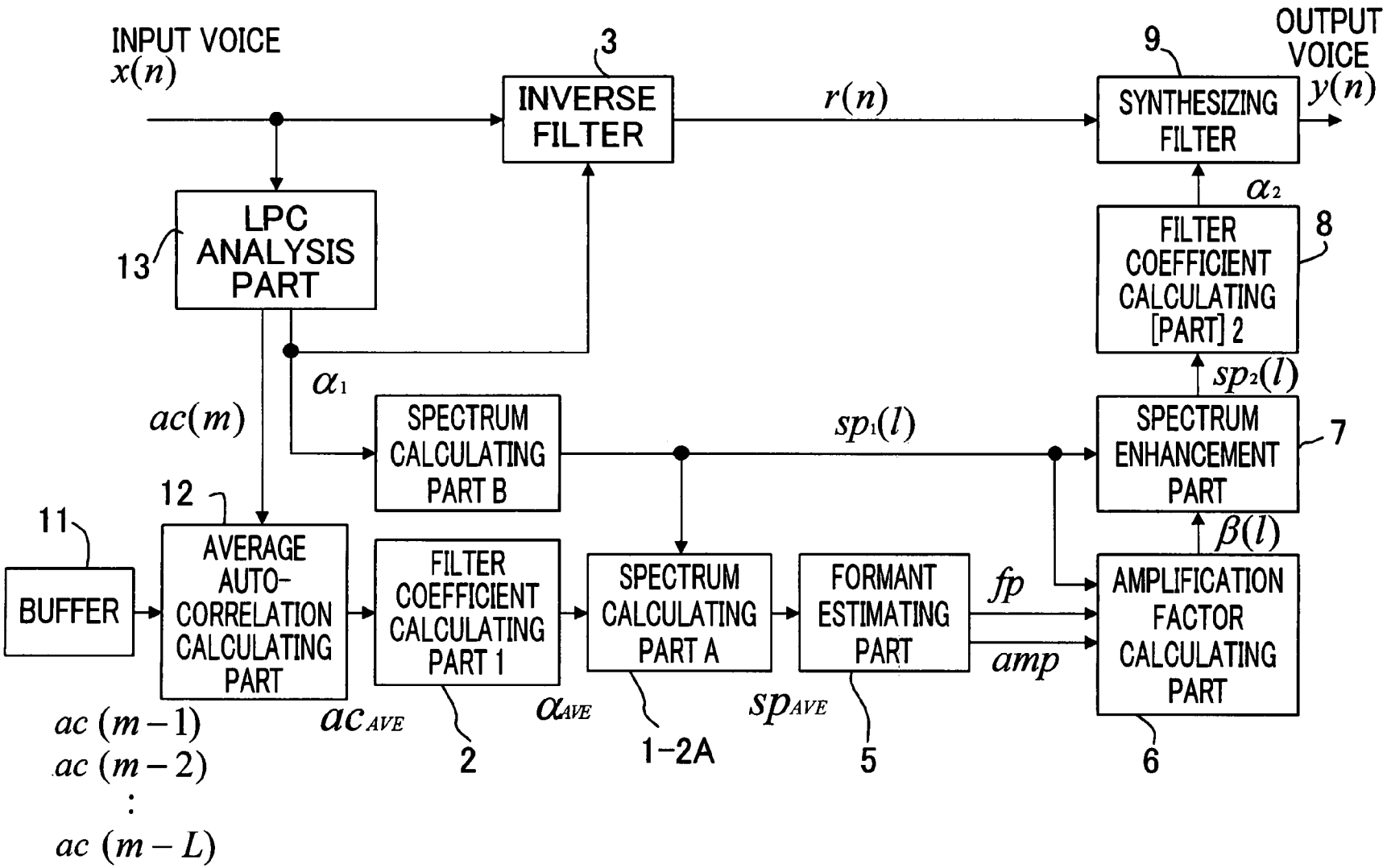
FIG. 14 is a diagram showing constituent blocks of a second embodiment of the present invention.

FIG. 14 shows a block diagram of the construction of a second embodiment of the present invention. This embodiment differs from the first embodiment shown in FIG. 10 in that the LPC coefficients determined from the input voice of the current frame are inverse filter coefficients; in all other respects, this embodiment is the same as the first embodiment.

Generally, in cases where a residual signal r(n) is determined from the input signal x(n) of the current frame, the predicted gain is higher in cases where LPC coefficients determined from the input signal of the current frame are used as the coefficients of the inverse filter 3 than it is in cases where LPC coefficients that have average frequency characteristics (as in the first embodiment) are used, so that the vocal tract characteristics and sound source characteristics can be separated with good precision.

Accordingly, in this second embodiment, the input voice of the current frame is subjected to an LPC analysis by part of an LPC analysis part 13, and the LPC coefficients $\alpha_1(i)$, $(1 \leqq i \leqq p_1)$ that are thus obtained are used as the coefficients of the inverse filter 3.

The spectrum $sp_1(l)$ is determined from the LPC coefficients $\alpha_1(i)$ by the second spectrum calculating part 1-2B. The method used to calculate the spectrum $sp_1(l)$ is the same as that of Equation (4) in the first embodiment.

Next, the average spectrum is determined by the first spectrum calculating part, and the formant frequencies fp(k) and formant amplitudes amp(k) are determined in the formant estimating part 5 from this average spectrum.

Next, as in the previous embodiment, the amplification rate $\beta(l)$ is determined by the amplification rate calculating part 6 from the spectrum $sp_1(l)$, formant frequencies fp(k) and formant amplitudes amp(k), and spectrum emphasis is performed by the spectrum emphasizing part 7 on the basis of this amplification rate so that an emphasized spectrum $sp_2(l)$ is determined. The synthesizing filter coefficients $\alpha_2(i)$ that are set in the synthesizing filter 9 are determined from the emphasized spectrum $sp_2(l)$, and the output voice y(n) is obtained by inputting the residual difference signal r(n) into this synthesizing filter 9.

As was described above with reference to the second embodiment, the voice path characteristics and sound source characteristics of the current frame can be separated with good precision, and the clarity can be improved by smoothly performing emphasis processing of the voice path characteristics on the basis of the average spectrum in the present embodiment in the same manner as in the preceding embodiments.

Figure 15:
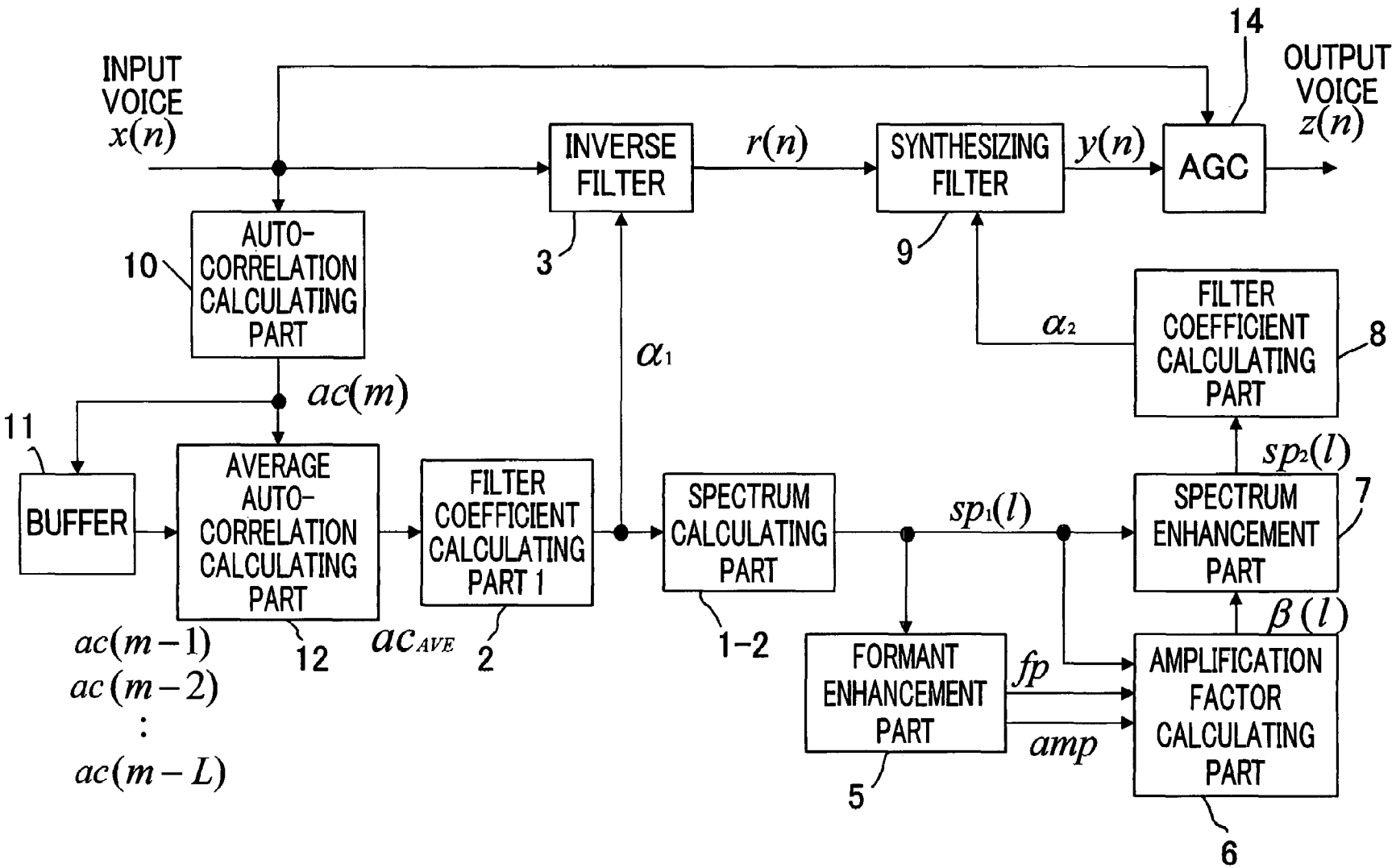
FIG. 15 is a diagram showing constituent blocks of a third embodiment of the present invention.

Next, a third embodiment of the present invention will be described with reference to FIG. 15. This third embodiment differs from the first embodiment in that an automatic gain control part (AGC part) 14 is installed, and the amplitude of the synthesized output y(n) of the synthesizing filter 9 is controlled; in all other respects, this construction is the same as the first embodiment.

The gain is adjusted by the AGC part 14 so that the power ratio of the final output voice signal z(n) to the input voice signal x(n) is 1. An arbitrary method can be used for the AGC part 14; for example, however, the following method can be used.

First, the amplitude ratio $g_0$ is determined by Equation (14) from the input voice signal x(n) and the synthesized output y(n). Here, N is the frame length.

$$g_0 = \sqrt{\frac{\sum_{n=0}^{N-1} x(n)^2}{\sum_{n=0}^{N-1} y(n)^2}} \tag{14}$$

The automatic gain control value Gain(n) is determined by the following Equation (15). Here, λ is a constant.

$$\mathrm{Gain}(n)=(1-\lambda)\cdot\mathrm{Gain}(n-1)+\lambda\cdot g_0,\ (0 \leqq n \leqq N-1) \tag{15}$$

The final output voice signal z(n) is determined by the following Equation (16).

$$z(n)=\mathrm{Gain}(n)\cdot y(n),\ (0 \leqq n \leqq N-1) \tag{16}$$

In the present embodiment as well, as was described above, the input voice x(n) can be separated into sound source characteristics and voice path characteristics, and the system can be devised so that only the voice path characteristics are emphasized. As a result, distortion of the spectrum that occurs when the voice path characteristics and sound source characteristics are simultaneously emphasized, which is a problem in conventional techniques, can be suppressed, and the clarity can be improved.

Furthermore, by adjusting the gain so that the amplitude of the output voice is not excessively increased compared to the input signal as a result of spectrum emphasis, it is possible to obtain a smooth and highly natural output voice.

Figure 16:
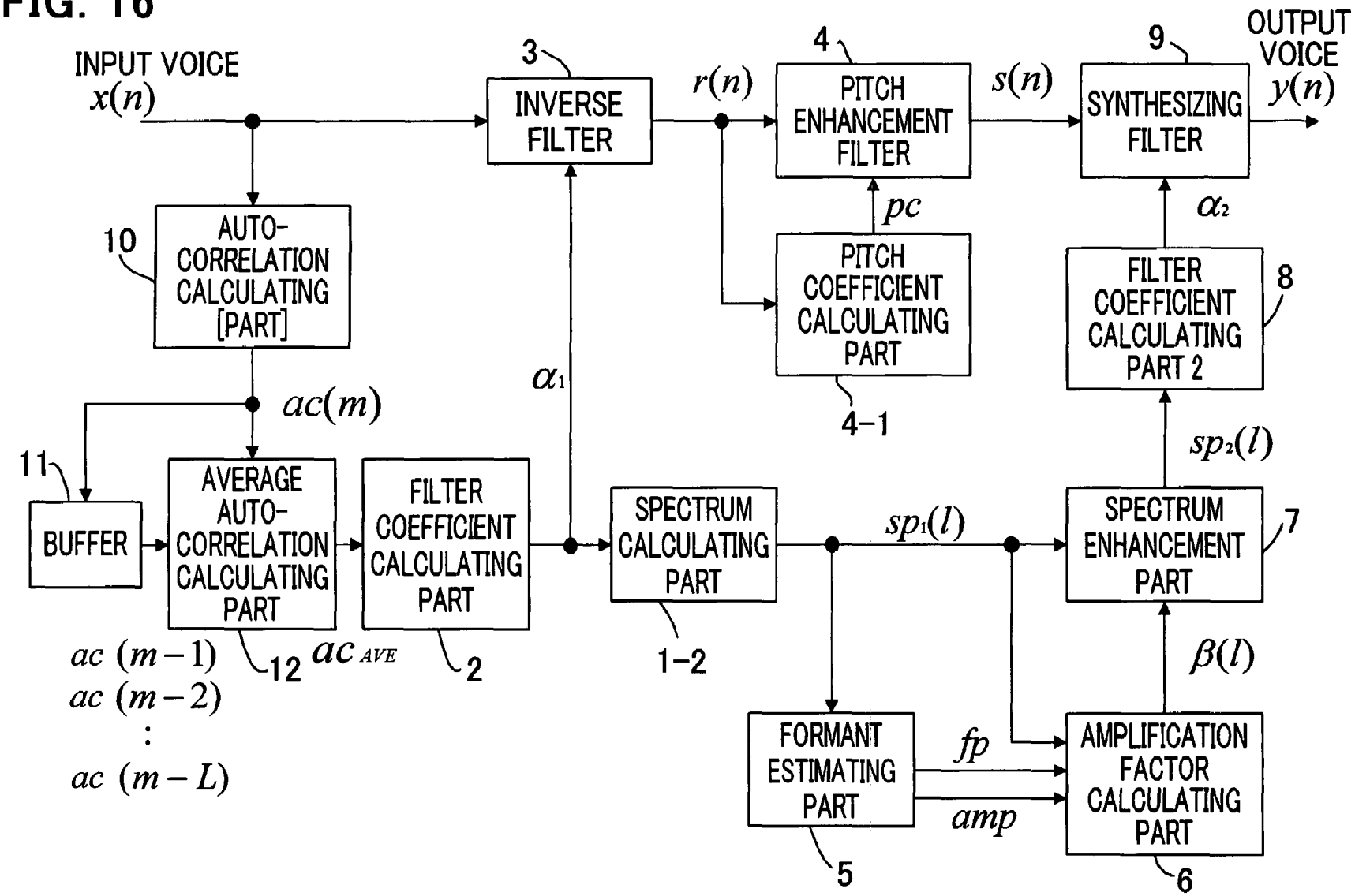
FIG. 16 is a diagram showing constituent blocks of a fourth embodiment of the present invention.

FIG. 16 shows a block diagram of a fourth embodiment of the present invention. This embodiment differs from the first embodiment in that pitch emphasis processing is applied to the residual difference signal r(n) constituting the output of the reverse filter 3 in accordance with the principle diagram shown in FIG. 9; in all other respects, this construction is the same as the first embodiment.

The method of pitch emphasis performed by the pitch emphasizing filter 4 is arbitrary; for example, a pitch coefficient calculating part 4-1 can be installed, and the following method can be used.

First, the self-correlation rscor(i) of the residual difference signal of the current frame is determined by Equation (17), and the pitch lag T at which the self-correlation rscor(i) shows a maximum value is determined. Here, $Lag_{min}$ and $Lag_{max}$ are respectively the lower limit and upper limit of the pitch lag.

$$rscor(i) = \sum_{n=i}^{N-1} r(n)\cdot r(n-i),\ (Lag_{\min} \le i \le Lag_{\max}) \tag{17}$$

Next, pitch prediction coefficients pc(i), (i=−1, 0, 1) are determined by the self-correlation method from the residual difference signals rscor(T−1), rscor(T) and rscor(T+1) in the vicinity of the pitch lag T. In regard to the method used to calculate the pitch prediction coefficients, these coefficients can be determined by a universally known method such as a Levinson algorithm or the like.

Next, the reverse filter output r(n) is input into the pitch emphasizing filter 4, and a voice y(n) with an emphasized pitch periodicity is determined. A filter expressed by the transfer function of Equation (18) can be used as the pitch emphasizing filter 4. Here, $g_p$ is a weighting coefficient.

$$Q(z) = \frac{1}{1 + g_p \sum_{i=-1}^{1} pc(i) \cdot z^{-(i+T)}} \tag{18}$$

Here, furthermore, an IIR filter was used as the pitch emphasizing filter 4; however, it would also be possible to use an arbitrary filter such as an FIR filter or the like.

In the fourth embodiment, pitch period components contained in the residual difference signal can be emphasized by adding a pitch emphasizing filter as was described above, and the voice clarity can be improved even further than in the first embodiment.

Figure 17:
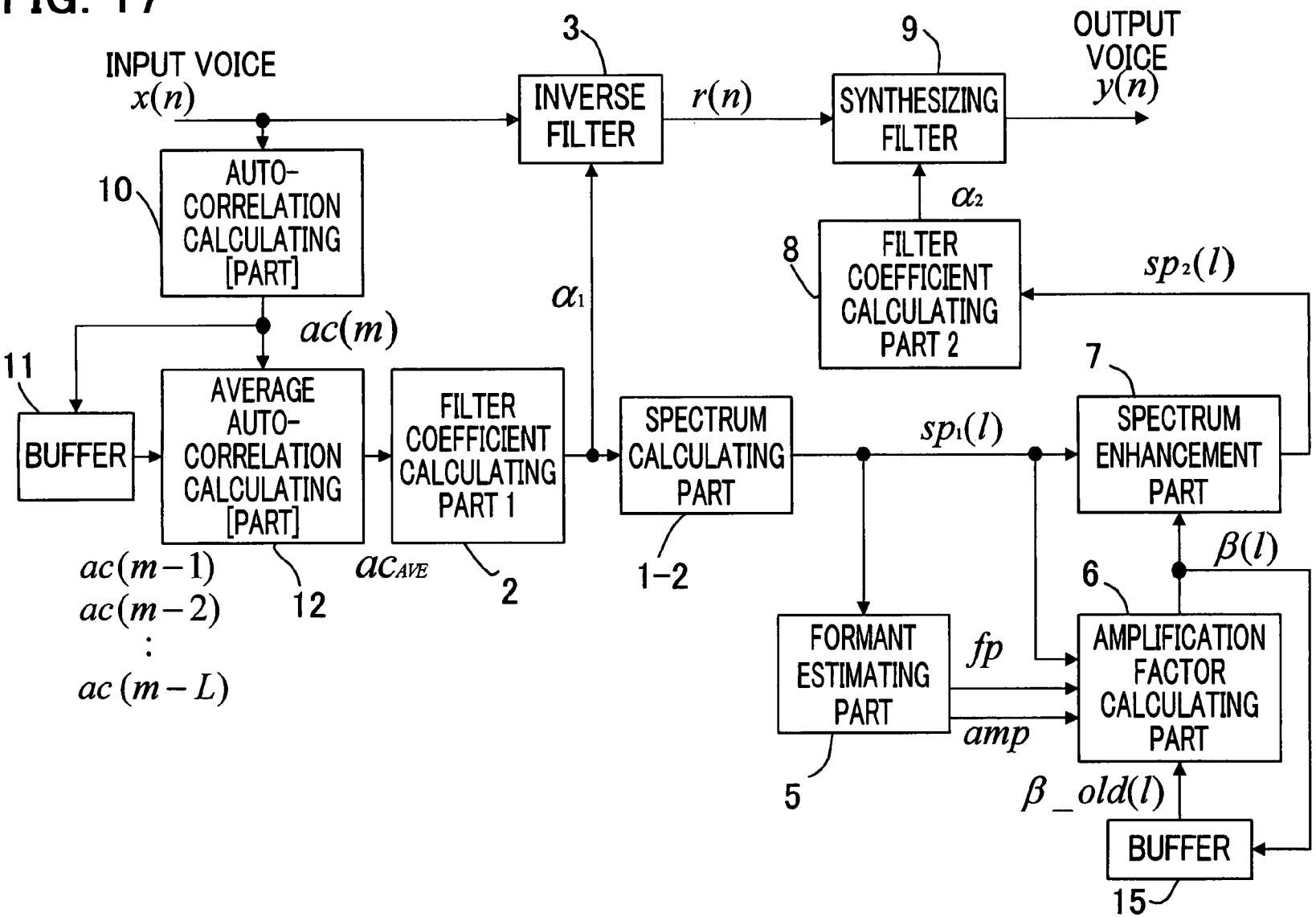
FIG. 17 is a diagram showing constituent blocks of a fifth embodiment of the present invention.

FIG. 17 shows a block diagram of the construction of a fifth embodiment of the present invention. This embodiment differs from the first embodiment in that a second buffer part 15 that holds the amplification rate of the preceding frame is provided; in all other respects, this embodiment is the same as the first embodiment.

In this embodiment, a tentative amplification rate $\beta_{psu}(l)$ is determined in the amplification rate calculating part 6 from the formant frequencies fp(k) and amplitudes amp(k) and the spectrum $sp_1(l)$ from the spectrum calculating part 1-2.

The method used to calculate the tentative amplification rate $\beta_{psu}(l)$ is the same as the method used to calculate the amplification rate $\beta(l)$ in the first embodiment. Next, the amplification rate $\beta(l)$ of the current frame is determined from the tentative amplification rate $\beta_{psu}(l)$ and the amplification rate β_old(l) of the preceding frame output from the buffer part 15. Here, the amplification rate β_old(l) of the preceding frame is the final amplification rate calculated in the preceding frame.

The procedure used to determine the amplification rate $\beta(l)$ is as follows:

(1) The difference between the tentative amplification rate $\beta_{psu}(l)$ and preceding frame amplification rate β_old(l), i. e., $\Delta_\beta = \beta_{psu}(l) - \beta_old(l)$, is calculated.

(2) In cases where the difference $\Delta_\beta$ is greater than a predetermined threshold value $\Delta_{TH}$, $\beta(l)$ is taken to be equal to $\beta_old(l) + \Delta_{TH}$.

(3) In cases where the difference $\Delta_\beta$ is smaller than the threshold value $\Delta_{TH}$, $\beta(l)$ is taken to be equal to $\beta_{psu}(l)$ (4) The $\beta(l)$ that is finally determined is input ito the buffer part 15, and the preceding frame amplification rate β_old(l) is updated.

In the fifth embodiment, since the procedure is the same as that of the first embodiment except for the part in which the amplification rate $\beta(l)$ is determined with reference to the preceding frame amplification rate β_old(l), further description of the operation of the fifth embodiment will be omitted.

In the present embodiment, as was described above, abrupt variation of the amplification rate between frames is prevented by selectively using the amplification rate in the preceding frame when the amplification rate used in spectrum emphasis is determined; accordingly, the clarity can be improved while suppressing an increase in the feeling of noise caused by spectrum emphasis.

Figure 18:
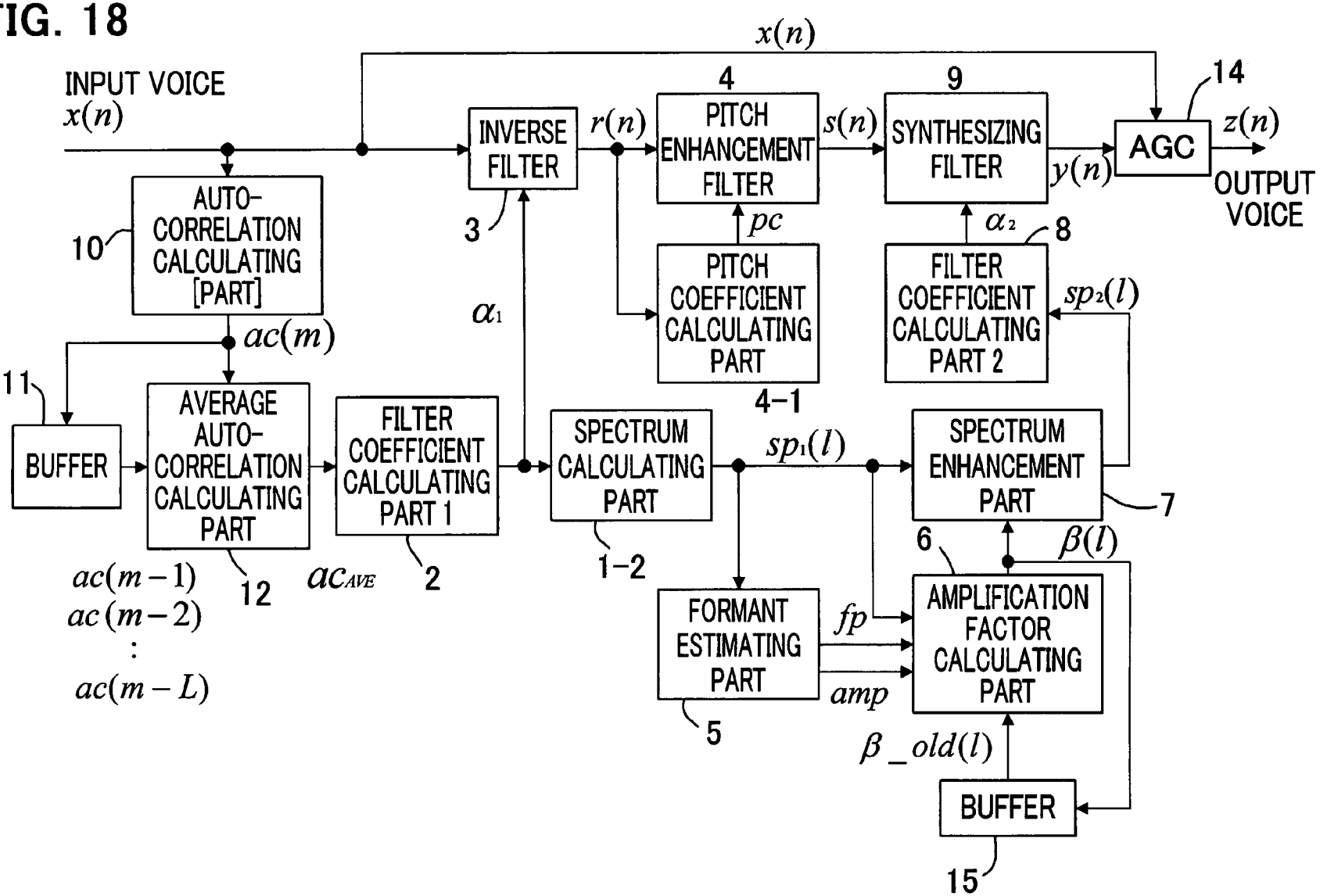
FIG. 18 is a diagram showing constituent blocks of a sixth embodiment of the present invention.

FIG. 18 shows a block diagram of the construction of a sixth embodiment of the present invention. This embodiment shows a construction combining the abovementioned first and third through fifth embodiments. Since duplicated parts are the same as in the other embodiments, a description of such parts will be omitted.

Figure 1:
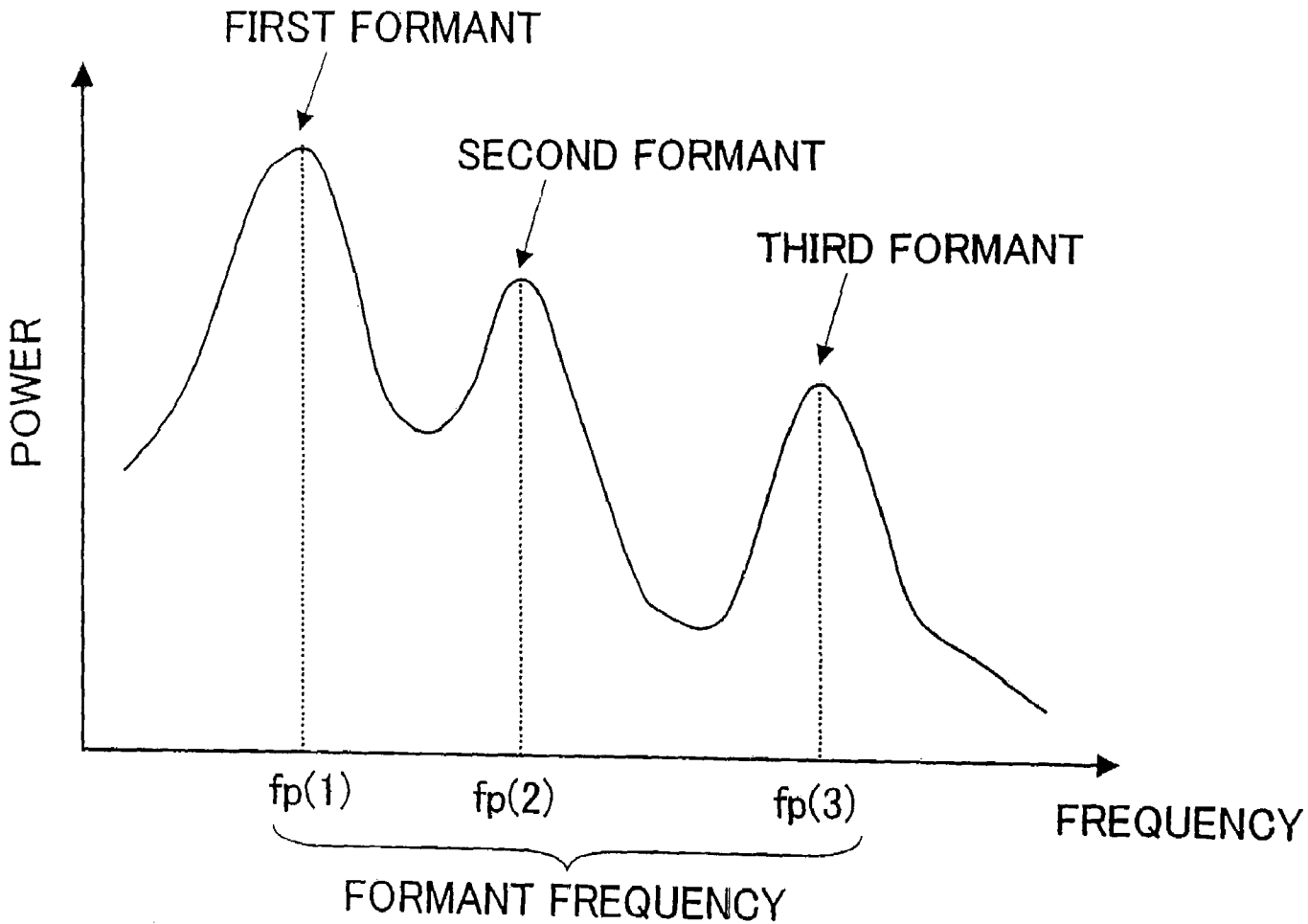
FIG. 1 PRIOR ART
FIG. 1 is a diagram which shows an example of the voice frequency spectrum.
Figure 2A:
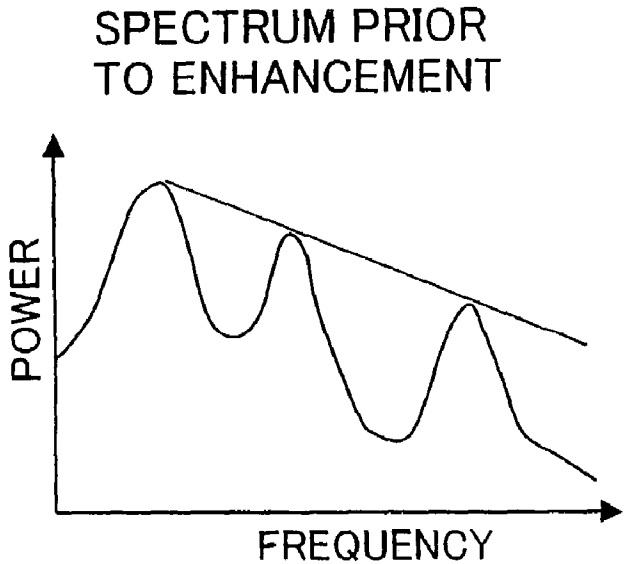
FIG. 2A PRIOR ART
FIG. 2 is a diagram which shows examples of the voice frequency spectrum before enhancement and after enhancement.
Figure 2B:
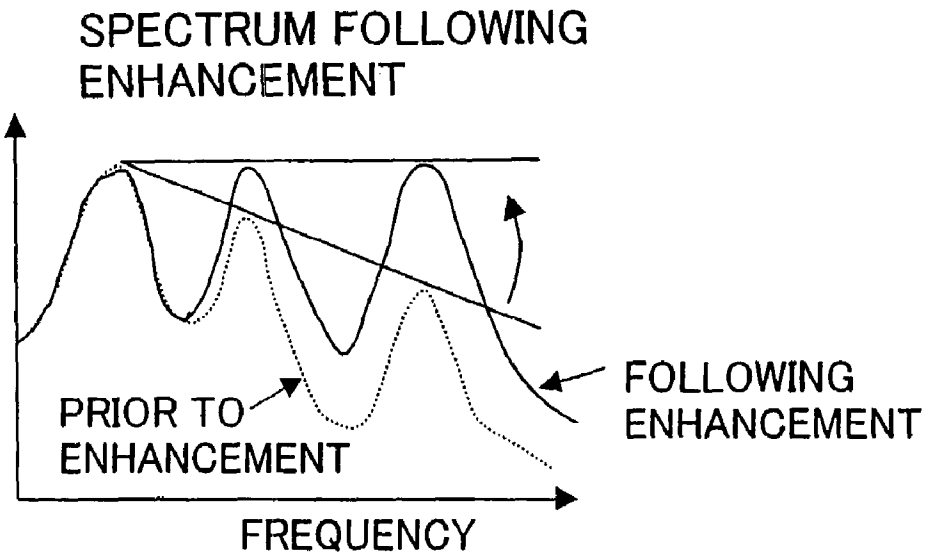
FIG. 2B PRIOR ART
Figure 3:
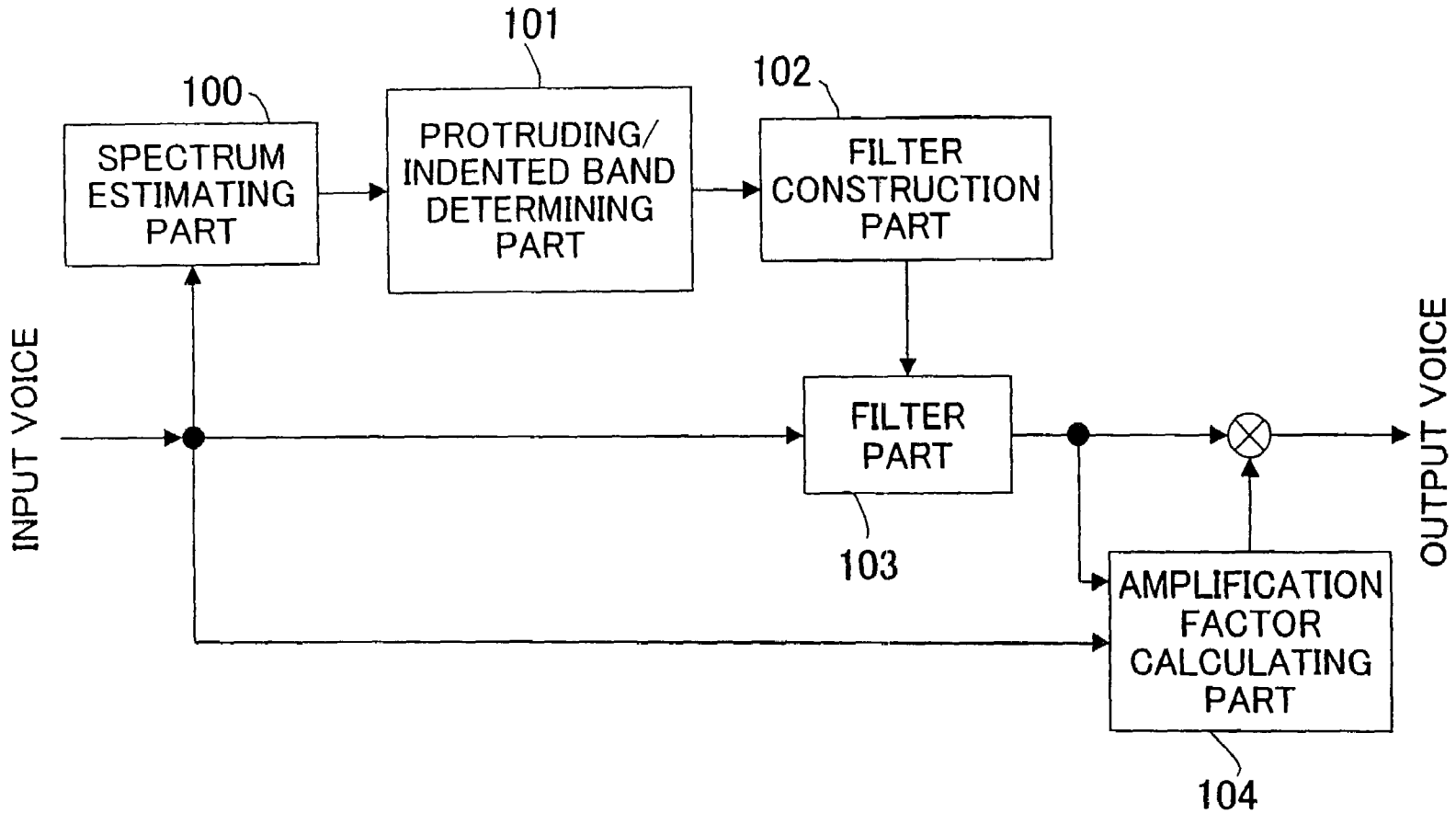
FIG. 3 PRIOR ART
FIG. 3 is a block diagram of the conventional technique described in Japanese Patent Application Laid-Open No. 2000-117573.
Figure 4:
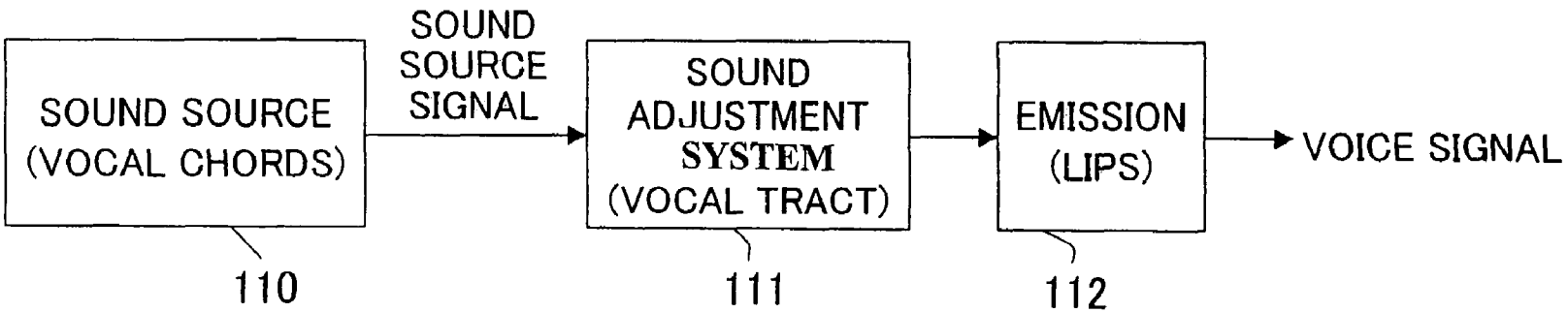
FIG. 4 PRIOR ART
FIG. 4 is a diagram which shows a voice production model.
Figure 5:
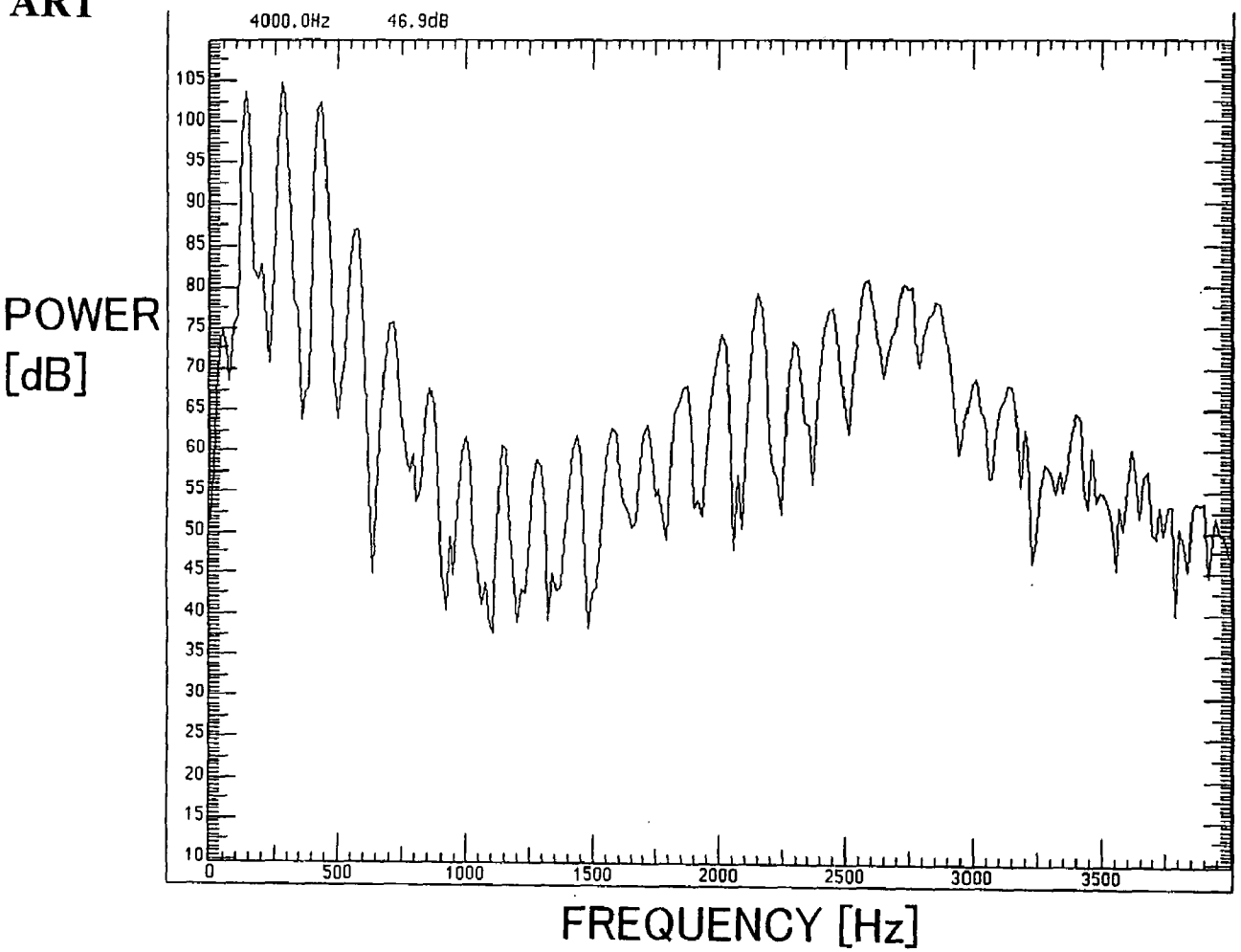
FIG. 5 PRIOR ART
FIG. 5 is a diagram which shows an example of the input voice spectrum.
Figure 6:
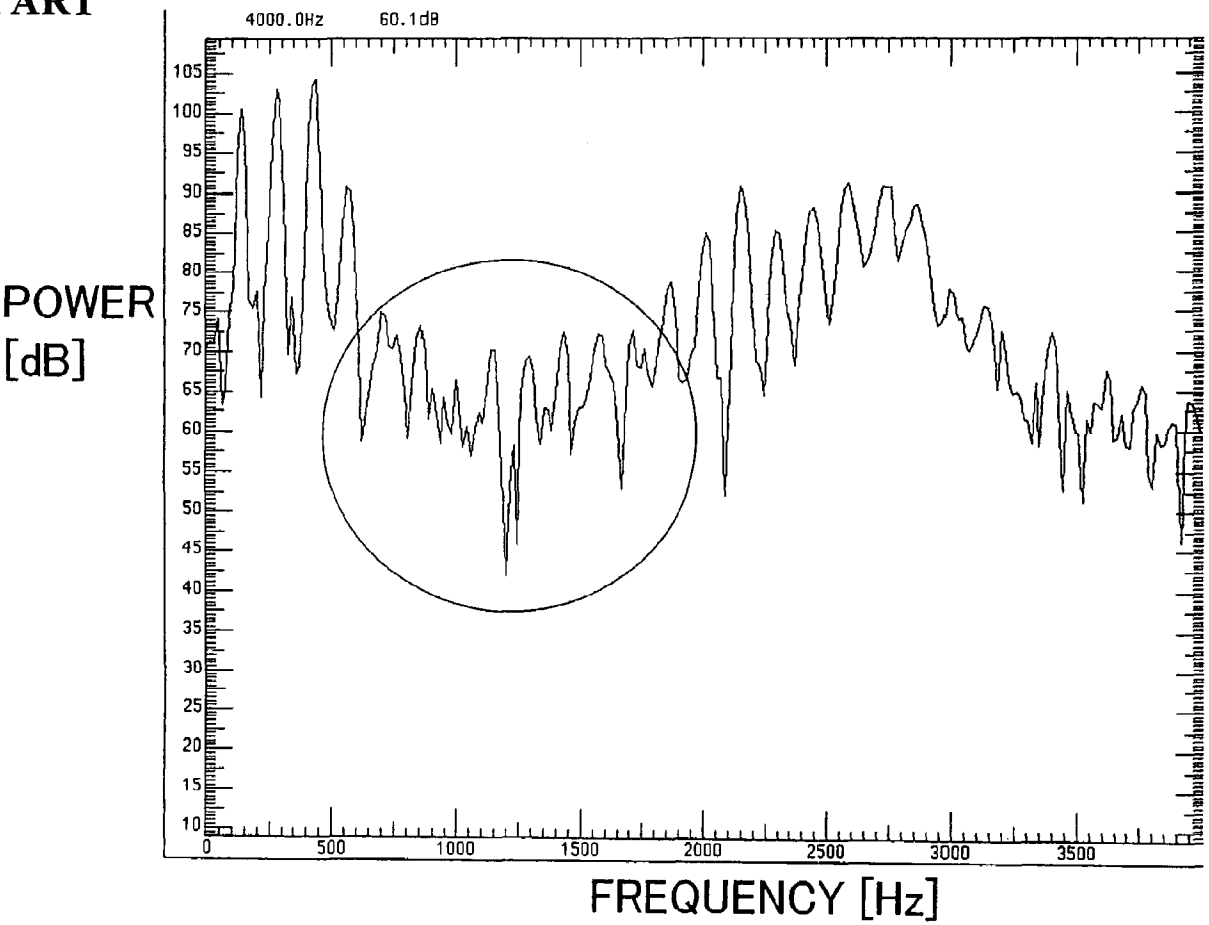
FIG. 6 PRIOR ART
FIG. 6 is a diagram which shows an example of the spectrum in a case where the spectrum is enhanced in frame units.
Figure 7:
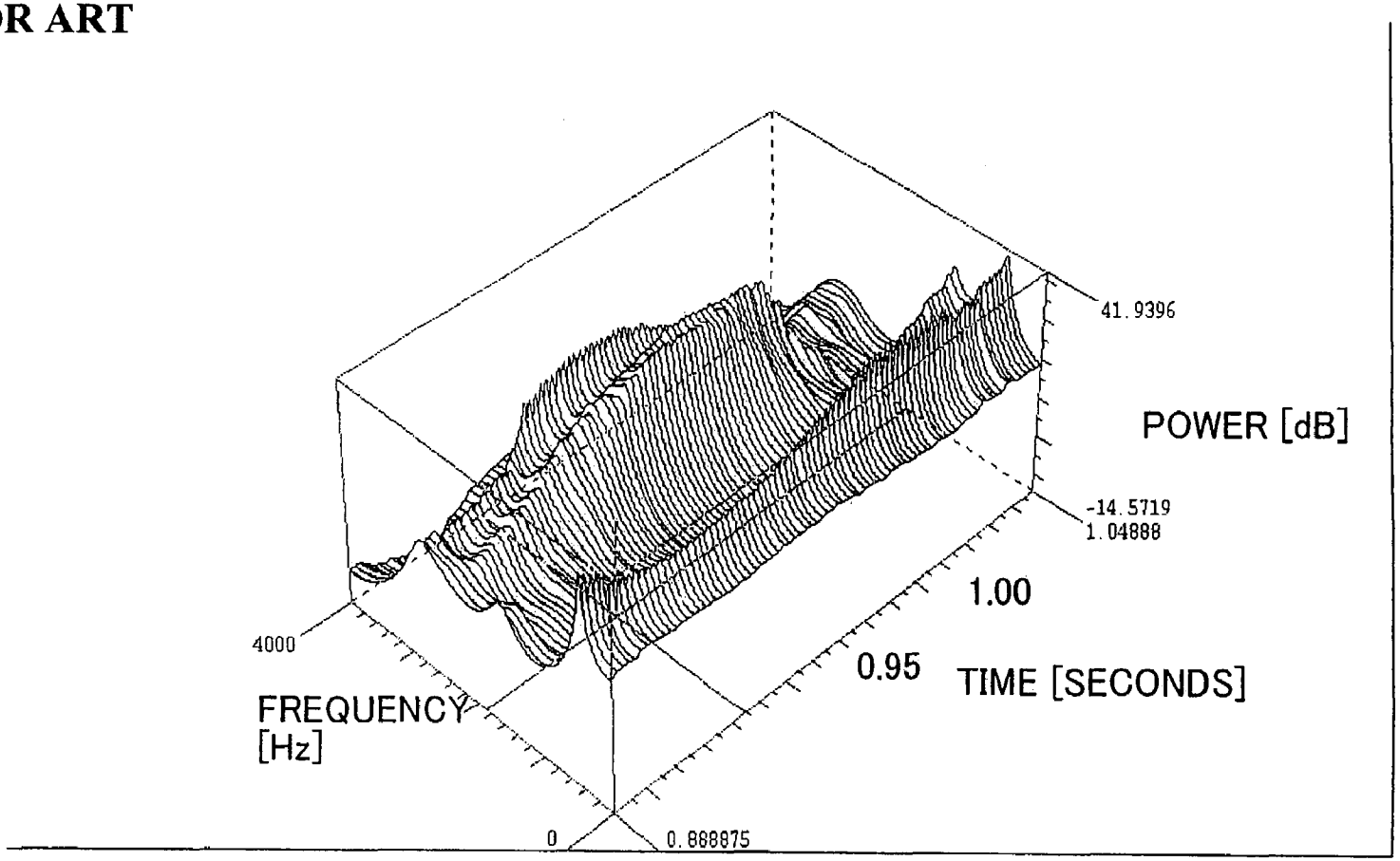
FIG. 7 PRIOR ART
FIG. 7 is a diagram which shows the input voice spectrum (before enhancement)
Figure 19:
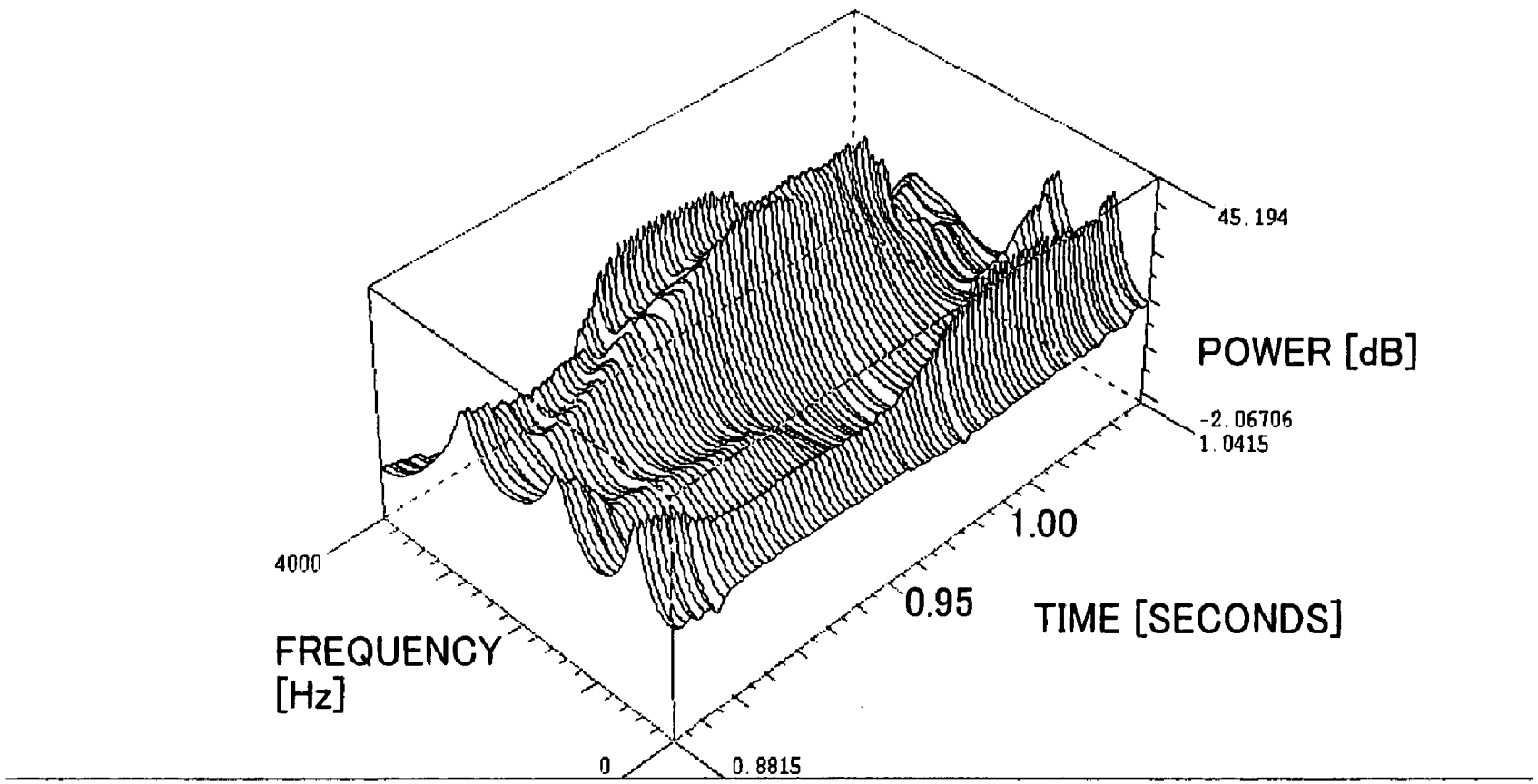
FIG. 19 is a diagram showing the spectrum enhanced by the present invention.

FIG. 19 is a diagram showing the voice spectrum emphasized by the abovementioned embodiment. The effect of the present invention is clear when the spectrum shown in FIG. 19 is compared with the input voice spectrum (prior to emphasis) shown in FIG. 7 and the spectrum emphasized in frame units shown in FIG. 8.

Figure 8:
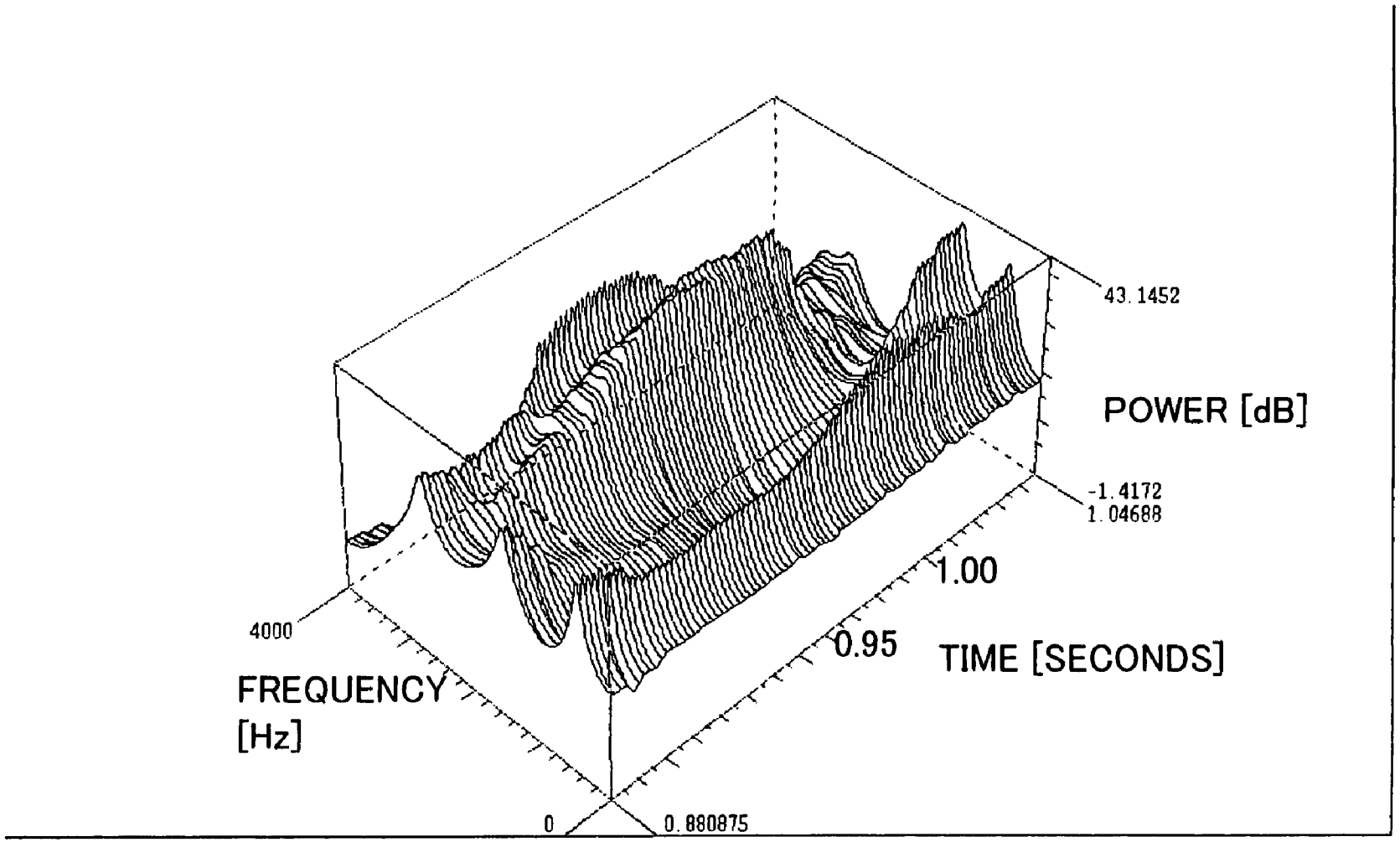
FIG. 8 is a diagram which shows the voice spectrum in a case where the voice spectrum is enhanced in frame units.

Specifically, in FIG. 8 in which the higher formants are emphasized, discontinuities are generated in the emphasized spectrum at around 0.95 seconds and at around 1.03 seconds; however, in the voice spectrum shown in FIG. 19, it is seen that peak fluctuation is suppressed, so that these discontinuities are ameliorated. As a result, there is no generation of a feeling of noise due to discontinuities in the formants when the processed voice is actually heard.

Here, in the abovementioned first through sixth embodiments, the input voice can be separated into sound source characteristics and voice path characteristics, and these voice path characteristics and sound source characteristics can be separately emphasized, on the basis of the principle diagram of the present invention shown in FIG. 9. Accordingly, distortion of the spectrum which has been a problem in conventional techniques in which the voice itself is emphasized can be suppressed, so that the clarity can be improved.

However, the following problems may arise in common in the respective embodiments described above. Specifically, in the respective embodiments described above, in cases where the voice spectrum is emphasized, the problem of an increase in noise arises if there is a great fluctuation in the amplification rate between frames. On the other hand, if the system is controlled so that fluctuations in the amplification rate are reduced in order to suppress the feeling of noise, the degree of spectrum emphasis becomes insufficient, so that the improvement in clarity is insufficient.

Figure 20:
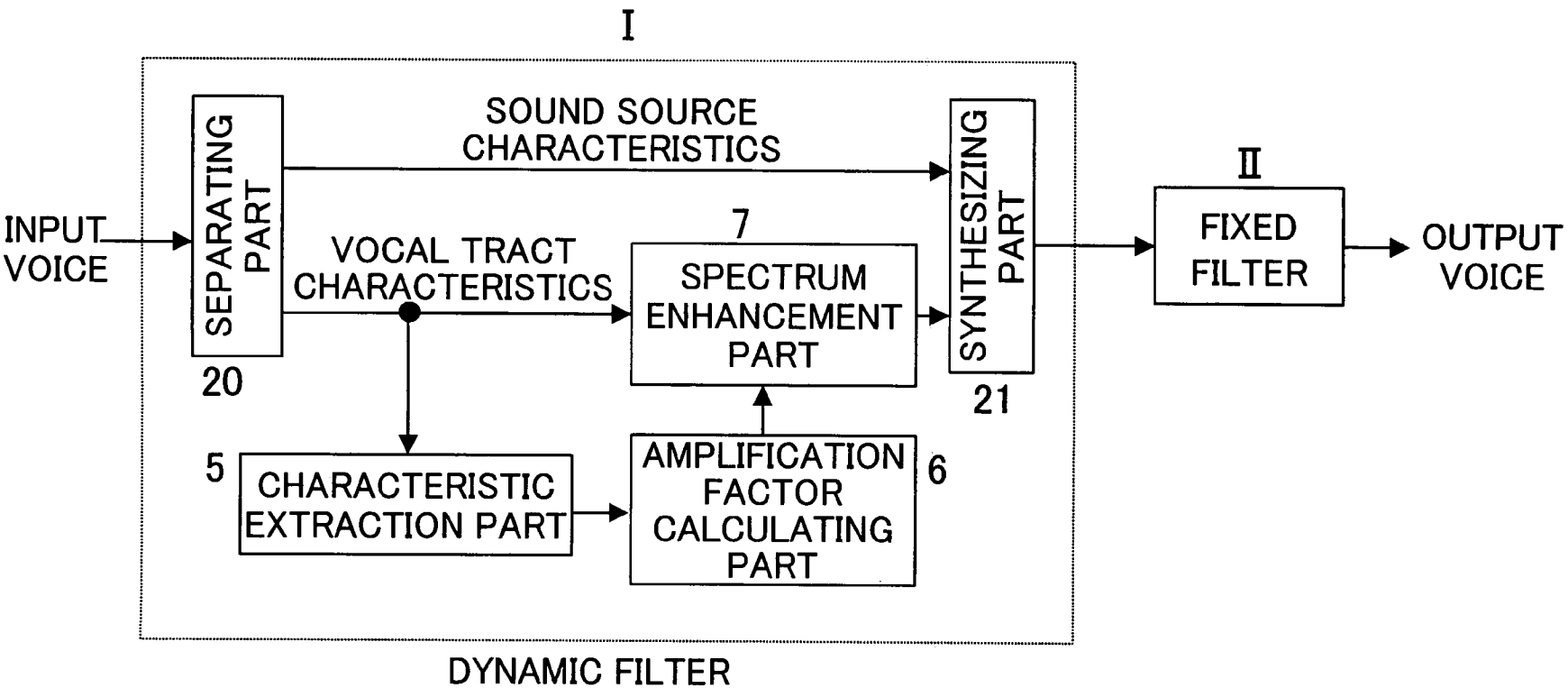
FIG. 20 is a structural diagram of the principle whereby the present invention further solves the problem of an increase in the feeling of noise when there is a great fluctuation in the amplification factor between frames.
Figure 21:
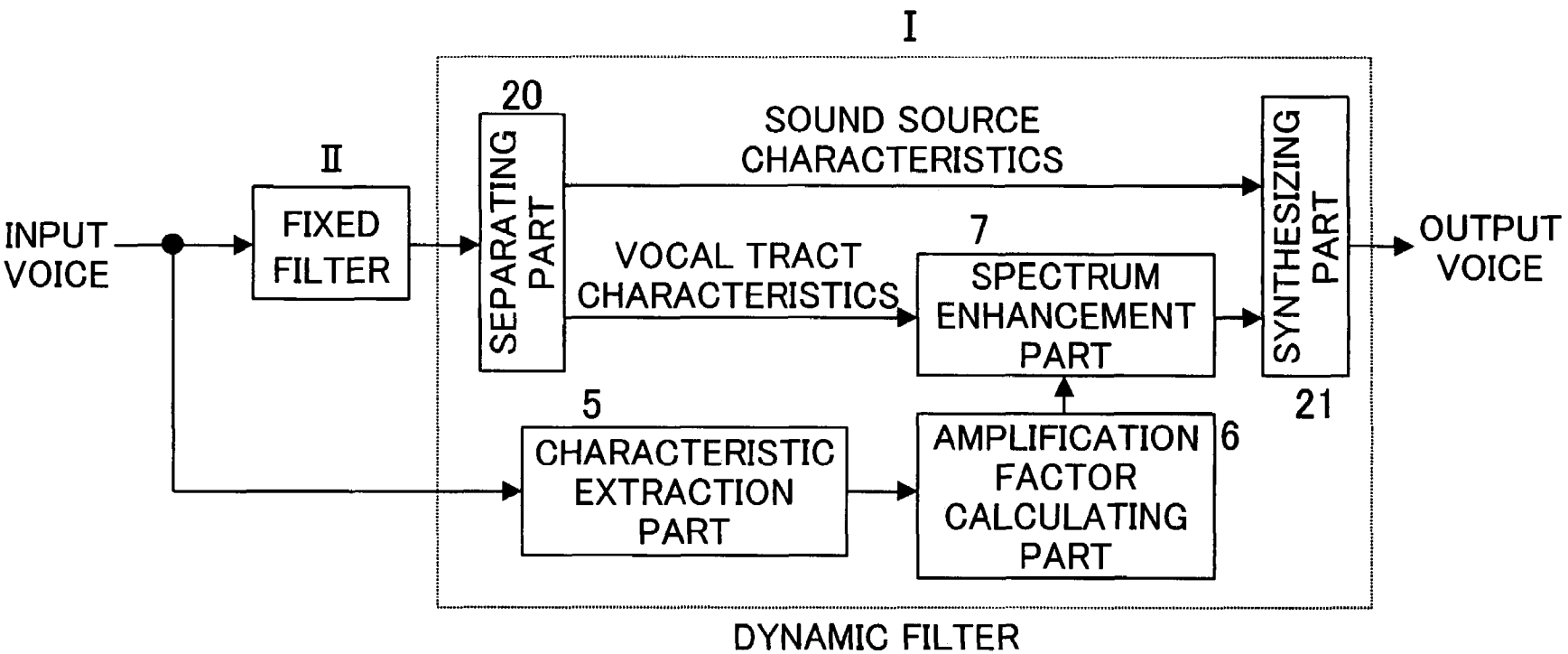
FIG. 21 is another structural diagram of the principle whereby the present invention further solves the problem of an increase in the feeling of noise when there is a great fluctuation in the amplification factor between frames.

Accordingly, in order to further eliminate such trouble, the construction based on the principle of the present invention shown in FIGS. 20 and 21 is applied. The construction based on the principle of the present invention shown in FIGS. 20 and 21 is characterized by the fact that a two-stage construction consisting of a dynamic filter I and a fixed filter II is used.

Furthermore, in the construction shown in FIG. 20, a principle diagram illustrating a case in which a fixed filter II is disposed after a dynamic filter I; however, it would also be possible to dispose a fixed filter II as the pre-stage if a dynamic filter I as shown in the construction illustrate in FIG. 21. However, in the case of the construction shown in FIG. 21, the parameters used in the dynamic filter I are calculated by analyzing the input voice.

As was described above, the dynamic filter I uses a construction based on the principle shown in FIG. 9. FIGS. 20 and 21 show an outline of the principle construction shown in FIG. 9. Specifically, the dynamic filter I comprises a separating functional part 20 which separates the input voice into sound source characteristics and voice path characteristics, a characteristic extraction functional part 5 which extracts formant characteristics from the voice path characteristics, an amplification rate calculating functional part 6 which calculates the amplification rate on the basis of formant characteristics obtained from the characteristic extraction functional part 5, a spectrum functional part 7 which emphasizes the spectrum of the voice path characteristics in accordance with the calculated amplification rate, and a synthesizing functional part 21 which synthesizes the sound source characteristics and the voice path characteristics whose spectrum has been emphasized.

The fixed filter II has filter characteristics that have a fixed pass band in the frequency width of a specified range. The frequency band that is emphasized by the fixed filter II is arbitrary; however, for example, a band emphasizing filter that emphasizes a higher frequency band of 2 kHz or greater or an intermediate frequency band of 1 kHz to 3 kHz can be sued.

A portion of the frequency band is emphasized by the fixed filter II, and the formants are emphasized by the dynamic filter I. Since the amplification rate of the fixed filter II is fixed, there is no fluctuation in the amplification rate between frames. By using such a construction, it is possible to prevent excessive emphasis by the dynamic filter I, and to improve the clarity.

Figure 22:
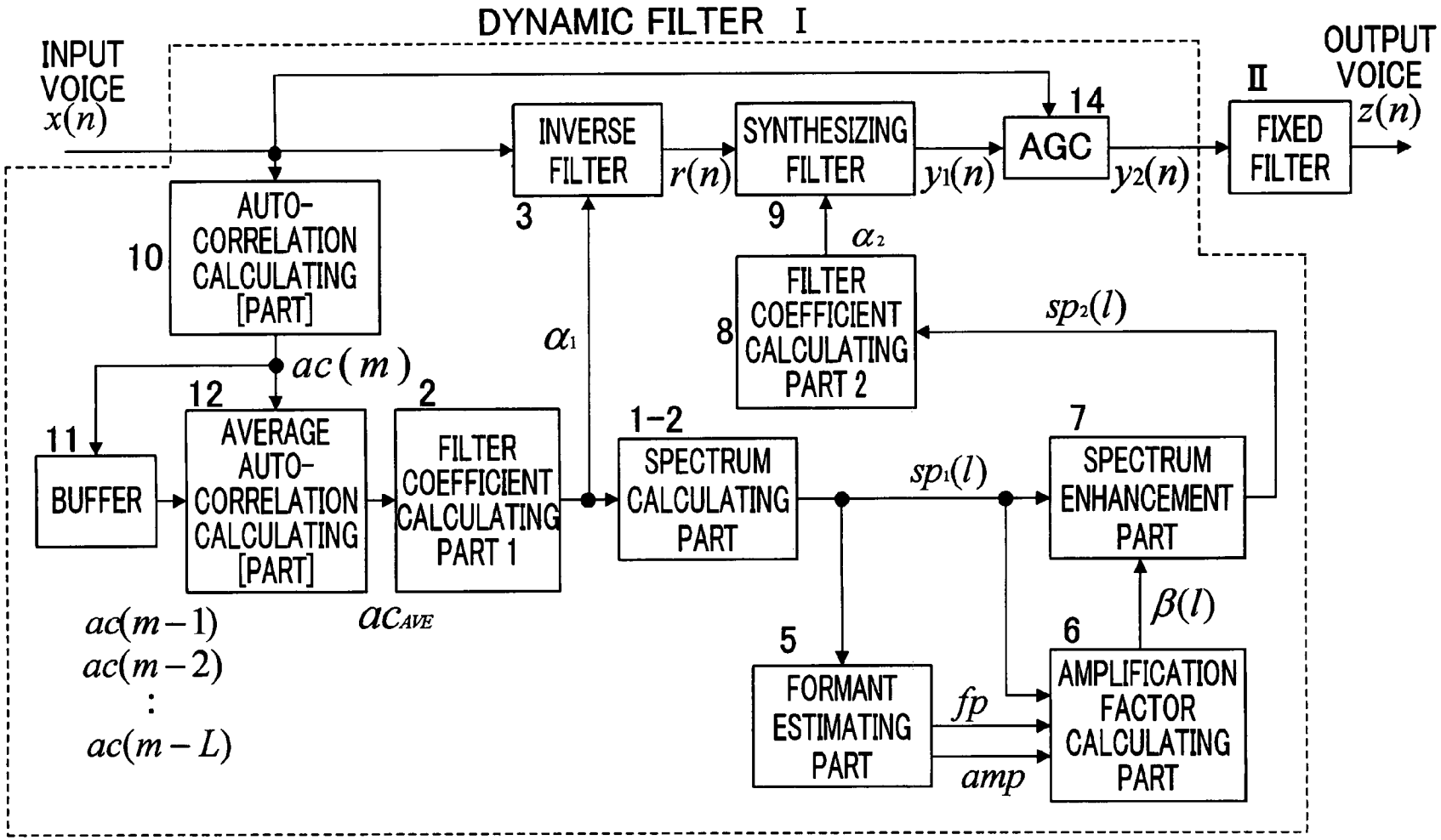
FIG. 22 is a diagram which shows the constituent blocks of an embodiment of the present invention according to the principle diagram shown in FIG. 20.

FIG. 22 is a block diagram of a further embodiment of the present invention based on the principle diagram shown in FIG. 20. This embodiment uses the construction of the third embodiment described previously as the dynamic filter I. Accordingly, a duplicate description is omitted.

In this embodiment, the input voice is separated into sound source characteristics and voice path characteristics by the dynamic filter I, and only the voice path characteristics are emphasized. As a result, the spectrum distortion that occurs when the voice path characteristics and sound source characteristics are simultaneously emphasized, which has been a problem in conventional techniques, can be suppressed, and the clarity can be improved. Furthermore, the gain is adjusted by the AGC part 14 so that the amplitude of the output voice is not excessively increased compared to the input signal as a result of emphasis of the spectrum; accordingly, a smooth and highly natural output voice can be obtained.

Furthermore, since a portion of the frequency band is amplified at a fixed rate by the fixed filter II, the feeling of noise is small, so that a voice with a high clarity can be obtained.

INDUSTRIAL APPLICABILITY

As was described above with reference to the figures, the present invention makes it possible to emphasize the voice path characteristics and sound source characteristics separately. As a result, the spectrum distortion that has been a problem in conventional techniques in which the voice itself is emphasized can be suppressed, so that the clarity can be improved.

Furthermore, since emphasis is performed on the basis of an average spectrum when the voice path characteristics are emphasized, the abrupt variation of the amplification rate between frames is ameliorated, so that a good sound quality with little feeling of noise can be obtained.

In view of such points, the present invention allows desirable voice communication in portable telephones, and therefore makes a further contribution to the popularization of portable telephones.

Furthermore, the present invention was described in terms of the abovementioned embodiments. However, such embodiments are used to facilitate understanding of the present invention; the protected scope of the present invention is not limited to these embodiments. Specifically, cases falling within a scope that is equivalent to the conditions described in the claims are also included in the protected scope of the present invention.

We claim:

1. A voice enhancement device comprising:

a signal separating part which separates an input voice signal into sound source characteristics and vocal tract characteristics;

a characteristic extraction part which extracts characteristic information from said vocal tract characteristics;

a corrected vocal tract characteristic calculating part which determines vocal tract characteristic correction information from said vocal tract characteristics and said characteristic information;

a vocal tract characteristic correction part which corrects the vocal tract characteristics using said vocal tract characteristic correction information; and signal synthesizing part for synthesizing said sound source characteristics and said corrected vocal tract characteristics from said vocal tract characteristic correction part;

wherein a voice synthesized by said signal synthesizing part is output;

wherein said signal separating part is a filter constructed by linear prediction (LPC) coefficients obtained by subjecting the input voice to linear prediction analysis; and wherein said linear prediction coefficients are determined from an average of self-correlation functions calculated from the input voice.

2. The voice enhancement device according to claim 1, wherein said linear prediction coefficients are determined from a weighted average of a self-correlation function calculated from the input voice of a current frame, and a self-correlation function calculated from the input voice of a past frame.

3. The voice enhancement device according to claim 1, wherein said linear prediction coefficients are determined from a weighted average of linear prediction coefficients calculated from the input voice of a current frame and linear prediction coefficients calculated from the input voice of a past frame.

4. The voice enhancement device according to claim 1, wherein said vocal tract characteristics is a linear prediction spectrum calculated from linear prediction coefficients obtained by subjecting said input voice to a linear prediction analysis, or a power spectrum determined by a Fourier transform of the input voice.

5. The voice enhancement device according to claim 1, wherein said characteristic extraction part determines the pole placement from linear prediction coefficients obtained by subjecting said input voice to a linear prediction analysis, and determines a formant frequency and formant amplitude or formant band width from said pole placement.

6. The voice enhancement device according to claim 1, wherein said characteristic extraction part determines a formant frequency and formant amplitude or formant band width from a linear prediction spectrum or power spectrum.

7. The voice enhancement device according to claim 5 or claim 6, wherein said vocal tract characteristic correction part determines the average amplitude of said formant amplitude, and varies said formant amplitude or formant band width in accordance with said average amplitude.

8. The voice enhancement device according to claim 6, wherein said vocal tract characteristic correction part determines the average amplitude of the linear prediction spectrum or said power spectrum, and varies said formant amplitude or formant band width in accordance with said average amplitude.

9. The voice enhancement device according to claim 1, wherein the amplitude of the output voice from said synthesizing part is controlled by an automatic gain control part.

10. The voice enhancement device according to claim 1, which further comprises a pitch enhancement part that performs pitch enhancement on a residual signal constituting said sound source characteristics.

11. The voice enhancement device according to claim 1, wherein said vocal tract characteristic correction part has a calculating part that determines a tentative amplification factor in a current frame, the difference or ratio of an amplification factor of a preceding frame and the tentative amplification factor in the current frame is determined, and in cases where said difference or ratio is greater than a predetermined threshold value, an amplification factor determined from said threshold value and the amplification factor of the preceding frame is taken as the amplification factor of the current frame, while in cases where said difference or ratio is smaller than said threshold value, said tentative amplification factor is taken as the amplification factor of the current frame.

12. A voice enhancement device comprising:

a self-correlation calculating part that determines a self-correlation function from an input voice of a current frame;

a buffer part which stores a self-correlation of said current frame, and which outputs a self-correlation function of a past frame;

an average self-correlation calculating part which determines a weighted average of the self-correlation of said current frame and the self-correlation function of said past frame;

a first filter coefficient calculating part which calculates inverse filter coefficients from the weighted average of said self-correlation functions;

an inverse filter which is constructed by said inverse filter coefficients;

a spectrum calculating part which calculates a frequency spectrum from said inverse filter coefficients;

a formant estimating part which estimates a formant frequency and formant amplitude from said calculated frequency spectrum;

an amplitude factor calculating part which determines an amplitude factor from said calculated frequency spectrum, said estimated formant frequency and said estimated formant amplitude;

a spectrum enhancement part which varies said calculated frequency spectrum on the basis of said amplitude factor, and determines the varied frequency spectrum;

a second filter coefficient calculating part which calculates a synthesizing filter coefficients from said varied frequency spectrum; and a synthesizing filter which is constructed from said synthesizing filter coefficients;

wherein a residual signal is determined by inputting said input voice into said inverse filter, and an output voice is determined by inputting said residual signal into said synthesizing filter.

13. The voice enhancement device according to claim 12, which further comprises an automatic gain control part that controls amplitude of synthesizing filter output, wherein a residual signal is determined by inputting said input voice into said inverse filter, a playback voice is determined by inputting said residual signal into said synthesizing filter, and the output voice is determined by inputting said playback voice into said automatic gain control part.

14. The voice enhancement device according to claim 12, further comprising:

a pitch enhancement coefficient calculating part which calculates pitch enhancement coefficients from said residual signal; and a pitch enhancement filter which is constructed by said pitch enhancement coefficients;

wherein a residual signal whose pitch periodicity is enhanced is determined by inputting into said pitch enhancement filter a residual signal determined by inputting said input voice into said inverse filter, and the output voice is determined by inputting said residual signal whose pitch periodicity has been enhanced into said synthesizing filter.

15. The voice enhancement device according to claim 12, wherein said amplitude factor calculating part comprises:

a tentative amplification factor calculating part which determines a tentative amplification factor of the current frame from the frequency spectrum calculated from said inverse filter coefficients by said spectrum calculating part, said formant frequency and said formant amplitude;

a difference calculating part which calculates the difference between said tentative amplification factor and an amplification factor of a preceding frame; and an amplification factor judgment part which takes an amplification factor determined from a predetermined threshold value and the amplification factor of the preceding frame in cases where said difference is greater than this threshold value, and which takes said tentative amplification factor as an amplification factor of the current frame in cases where said difference is smaller than said threshold value.

16. A voice enhancement device comprising:

a linear prediction coefficient analysis part which determines a self-correlation function and linear prediction coefficients by subjecting an input voice signal of a current frame to a linear prediction coefficient analysis;

an inverse filter that is constructed by said coefficients;

a first spectrum calculating part which determines a frequency spectrum from said linear prediction coefficients;

a buffer part which stores the self-correlation function of said current frame, and outputs the self-correlation function of a past frame;

an average self-correlation calculating part which determines a weighted average of a self-correlation of said current frame and the self-correlation function of said past frame;

a first filter coefficient calculating part which calculates average filter coefficients from the weighted average of said self-correlation functions;

a second spectrum calculating part which determines an average frequency spectrum from said average filter coefficients;

a formant estimating part which determines a formant frequency and formant amplitude from said average spectrum;

an amplitude factor calculating part which determines an amplitude factor from said average spectrum, said formant frequency and said formant amplitude;

a spectrum enhancement part which varies the frequency spectrum calculated by said first spectrum calculating part on the basis of said amplitude factor, and determines the varied frequency spectrum;

a second filter coefficient calculating part which calculates synthesizing filter coefficients from said varied frequency spectrum; and a synthesizing filter which is constructed from said synthesizing filter coefficients;

wherein a residual signal is determined by inputting said input signal into said inverse filter, and an output voice is determined by inputting said residual signal into said synthesizing filter.

17. A voice enhancement device comprising:

a self-correlation calculating part which determines a self-correlation function from an input voice of a current frame;

a buffer part which stores the self-correlation function of said current frame, and outputs the self-correlation function of a past frame;

an average self-correlation calculating part which determines a weighted average of the self-correlation of said current frame and the self-correlation function of said past frame;

a first filter coefficient calculating part which calculates inverse filter coefficients from a weighted average of said self-correlation functions;

an inverse filter which is constructed by said inverse filter coefficients;

a spectrum calculating part which calculates a frequency spectrum from said inverse filter coefficients;

a formant estimating part which estimates a formant frequency and formant amplitude from said frequency spectrum;

a tentative amplification factor calculating part which determines a tentative amplification factor of the current frame from said frequency spectrum, said formant frequency and said formant amplitude;

a difference calculating part which calculates a difference amplification factor from said tentative amplification factor and an amplification factor of a preceding frame; and an amplification factor judgment part which takes an amplification factor determined from a predetermined threshold value and the amplification factor of the preceding frame as an amplification factor of the current frame in cases where a difference is greater than this threshold value, and which takes said tentative amplification factor as the amplification factor of the current frame in cases where said difference is smaller than said threshold value;

this voice enhancement device further comprising:

a spectrum enhancement part which varies said frequency spectrum on the basis of the amplification factor of said current frame, and which determines the varied frequency spectrum;

a second filter coefficient calculating part which calculates synthesizing filter coefficients from said varied frequency spectrum;

a synthesizing filter which is constructed from said synthesizing filter coefficients;

a pitch enhancement coefficient calculating part which calculates pitch enhancement coefficients from a residual signal; and a pitch enhancement filter which is constructed by said pitch enhancement coefficients;

wherein a residual signal is determined by inputting said input voice into said inverse filter, a residual signal whose pitch periodicity is enhanced is determined by inputting said residual signal into said pitch enhancement filter, and an output voice is determined by inputting said residual signal whose pitch periodicity has been enhanced into said synthesizing filter.

18. A voice enhancement device comprising:

an enhancement filter which enhances some of the frequency bands of an input voice signal;

a signal separating part which separates the input voice signal that has been enhanced by said enhancement filter into sound source characteristics and vocal tract characteristics;

a characteristic extraction part which extracts characteristic information from said vocal tract characteristics;

a corrected vocal tract characteristic calculating part which determines vocal tract characteristic correction information from said vocal tract characteristics and said characteristic information;

a vocal tract characteristic correction part which corrects said vocal tract characteristics using said vocal tract characteristic correction information; and signal synthesizing part for synthesizing said sound source characteristics and the corrected vocal tract characteristics from said vocal tract characteristic correction part;

wherein a voice synthesized by said signal synthesizing part is output;

wherein said signal separating part are a filter constructed by linear prediction (LPC) coefficients obtained by subjecting the input voice to linear prediction analysis; and wherein said linear prediction coefficients are determined from an average of self-correlation functions calculated from the input voice.

19. A voice enhancement device comprising:

a signal separating part which separates an input voice signal into sound source characteristics and vocal tract characteristics;

a characteristic extraction part which extracts characteristic information from said vocal tract characteristics;

a corrected vocal tract characteristic calculating part which determines vocal tract characteristic correction information from said vocal tract characteristics and said characteristic information;

a vocal tract characteristic correction part which corrects said vocal tract characteristics using said vocal tract characteristic correction information;

a signal synthesizing part which synthesizes said sound source characteristics and the corrected vocal tract characteristics from said vocal tract characteristic correction part; and a filter which enhances some of the frequency bands of a signal synthesized by said signal synthesizing part;

wherein said signal separating part are a filter constructed by linear prediction (LPC) coefficients obtained by subjecting the input voice to linear prediction analysis, and;

wherein said linear prediction coefficients are determined from an average of self-correlation functions calculated from the input voice.

* * * * *